US006703976B2

(12) United States Patent
Jacomb-Hood et al.

(10) Patent No.: US 6,703,976 B2
(45) Date of Patent: Mar. 9, 2004

(54) SCALEABLE ANTENNA ARRAY ARCHITECTURE USING STANDARD RADIATING SUBARRAYS AND AMPLIFYING/BEAMFORMING ASSEMBLIES

(75) Inventors: Anthony W. Jacomb-Hood, Yardley, PA (US); Erik Lier, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 44 days.

(21) Appl. No.: 09/989,187

(22) Filed: Nov. 21, 2001

(65) Prior Publication Data

US 2003/0189515 A1 Oct. 9, 2003

(51) Int. Cl.[7] ..... H01Q 3/24; H01Q 3/26
(52) U.S. Cl. ..... 342/373
(58) Field of Search ..... 342/373, 368; 343/777, 778, 824

(56) References Cited

U.S. PATENT DOCUMENTS 4,939,527 A 7/1990 Lamberty et al.
5,459,474 A 10/1995 Mattioli et al.
5,666,128 A 9/1997 Murray et al.
5,675,343 A * 10/1997 Champeau ..... 342/373
6,232,920 B1 5/2001 Brookner et al.
6,246,364 B1 6/2001 Roa et al.
6,362,780 B1 * 3/2002 Butz et al. ..... 342/373
6,366,238 B1 * 4/2002 DeMore et al. ..... 342/368
2002/0171583 A1 * 11/2002 Purdy et al. ..... 342/368
2002/0171585 A1 * 11/2002 Eiges ..... 342/373

FOREIGN PATENT DOCUMENTS

EP 0798209 10/1997

* cited by examiner

*Primary Examiner*—Thomas H. Tarcza
*Assistant Examiner*—F H Mull
(74) *Attorney, Agent, or Firm*—Townsend and Townsend and Crew LLP

(57) ABSTRACT

A phased array antenna design that is modular and scaleable in terms of beam quantity, coverage area, and receive sensitivity/transmit EIRP. A modular array building block for an antenna array comprises: a plurality of antenna elements, each antenna element operable to receive and output an electromagnetic wave signal, the antenna elements arranged adjacent to each other, a plurality of antenna element interface assemblies; each antenna element interface assembly coupled to one of the plurality of antenna elements and coupling the received signal to an amplifier, and a plurality of circuit board assemblies, the circuit board assemblies arranged substantially parallel to each other, each circuit board assembly comprising: a plurality of amplifiers, each amplifier operable to amplify a received signal from an antenna element, and a plurality of beamformers, each beamformers coupled to an output of an amplifier, wherein the circuit board assemblies, antenna element interface assemblies and antenna elements are arranged so as to form a module.

152 Claims, 31 Drawing Sheets

| SCAN REQUIREMENT | BEAM QUANTITY | ANTENNA ELEMENT | | AMPLIFIER/BFM/M BOARDS | | | BEAM COMBINERS | |
|---|---|---|---|---|---|---|---|---|
| | | TYPE | QUANTITY | BOARD QUANTITY | AMP/BOARD QUANTITY | BFM/M LOCATIONS | TYPE | QUANTITY |
| ±8.7° X ±8.7° | 32 | 1 X 1 | 64 | 8 | 8 | A,B,C,D | 8:1 | 32 |
| ±8.7° X ±8.7° | 16 | 1 X 1 | 64 | 8 | 8 | A,C | 8:1 | 16 |
| ±4° X ±8.7° | 32 | 2 X 1 | 32 | 8 | 4 | A,B | 8:1 | 32 |
| ±4° X ±8.7° | 16 | 2 X 1 | 32 | 8 | 4 | A | 8:1 | 16 |
| ±8.7° X ±4° | 32 | 1 X 2 | 32 | 4 | 8 | A,B,C,D | 4:1 | 32 |
| ±8.7° X ±4° | 16 | 1 X 2 | 32 | 4 | 8 | A,C | 4:1 | 16 |
| ±2° X ±8.7° | 32 | 4 X 1 | 16 | 4 | 4 | A,B | 4:1 | 32 |
| ±2° X ±8.7° | 16 | 4 X 1 | 16 | 4 | 4 | A | 4:1 | 16 |
| ±8.7° X ±2° | 32 | 1 X 4 | 16 | 2 | 8 | A,B,C,D | 2:1 | 32 |
| ±8.7° X ±2° | 16 | 1 X 4 | 16 | 2 | 8 | A,C | 2:1 | 16 |
| ±4° X ±4° | 32 | 2 X 2 | 16 | 4 | 4 | A,B | 4:1 | 32 |
| ±4° X ±4° | 16 | 2 X 2 | 16 | 4 | 4 | A | 4:1 | 16 |
| ±2° X ±4° | 32 | 4 X 2 | 8 | 2 | 4 | A,B | 2:1 | 32 |
| ±2° X ±4° | 16 | 4 X 2 | 8 | 2 | 4 | A | 2:1 | 16 |
| ±4° X ±2° | 32 | 2 X 4 | 8 | 2 | 4 | A,B | 2:1 | 32 |
| ±4° X ±2° | 16 | 2 X 4 | 8 | 2 | 4 | A | 2:1 | 16 |
| ±2° X ±2° | 32 | 4 X 4 | 4 | 1 | 4 | A,B | – | 0 |
| ±2° X ±2° | 16 | 4 X 4 | 4 | 1 | 4 | A | – | 0 |

±8.7° x ±8.7°
64 1 x 1
elements
8 Amp/BFMM
Boards with 8
LNAs/board

±4° x ±8.7°
32 2 x 1
elements
8 Amp/BFMM
Boards with 4
LNAs/board

±8.7° x ±4°
32 1 x 2
elements
4 Amp/BFMM
Boards with 8
LNAs/board

±8.7° x ±2°
16 1 x 4
elements
2 Amp/BFMM
Boards with 8
LNAs/board

±2° x ±8.7°
16 4 x 1
elements
4 Amp/BFMM
Boards with 4
LNAs/board

±4° x ±4°
16 2 x 2
elements
4 Amp/BFMM
Boards with 4
LNAs/board

±2° x ±4°
8 4 x 2
elements
2 Amp/BFMM
Boards with 4
LNAs/board

±4° x ±2°
8 2 x 4
elements
2 Amp/BFMM
Boards with 4
LNAs/board

±2° x ±2°
4 4 x 4
elements
1 Amp/BFMM
Board with 4
LNAs/board

Fig. 8

| SCAN REQUIRE-MENT | BEAM QUANTITY | ANTENNA ELEMENT | | AMPLIFIER/BFMM BOARDS | | | BEAM COMBINERS | |
|---|---|---|---|---|---|---|---|---|
| | | TYPE | QUANTITY | BOARD QUANTITY | AMP/BOARD QUANTITY | BFMM LOCATIONS | TYPE | QUANTITY |
| ±8.7° X ±8.7° | 32 | 1 X 1 | 64 | 8 | 8 | A,B,C,D | 8:1 | 32 |
| ±8.7° X ±8.7° | 16 | 1 X 1 | 64 | 8 | 8 | A,C | 8:1 | 16 |
| ±4° X ±8.7° | 32 | 2 X 1 | 32 | 8 | 4 | A,B | 8:1 | 32 |
| ±4° X ±8.7° | 16 | 2 X 1 | 32 | 8 | 4 | A | 8:1 | 16 |
| ±8.7° X ±4° | 32 | 1 X 2 | 32 | 4 | 8 | A,B,C,D | 4:1 | 32 |
| ±8.7° X ±4° | 16 | 1 X 2 | 32 | 4 | 8 | A,C | 4:1 | 16 |
| ±2° X ±8.7° | 32 | 4 X 1 | 16 | 4 | 4 | A,B | 4:1 | 32 |
| ±2° X ±8.7° | 16 | 4 X 1 | 16 | 4 | 4 | A | 4:1 | 16 |
| ±8.7° X ±2° | 32 | 1 X 4 | 16 | 2 | 8 | A,B,C,D | 2:1 | 32 |
| ±8.7° X ±2° | 16 | 1 X 4 | 16 | 2 | 8 | A,C | 2:1 | 16 |
| ±4° X ±4° | 32 | 2 X 2 | 16 | 4 | 4 | A,B | 4:1 | 32 |
| ±4° X ±4° | 16 | 2 X 2 | 16 | 4 | 4 | A | 4:1 | 16 |
| ±2° X ±4° | 32 | 4 X 2 | 8 | 2 | 4 | A,B | 2:1 | 32 |
| ±2° X ±4° | 16 | 4 X 2 | 8 | 2 | 4 | A | 2:1 | 16 |
| ±4° X ±2° | 32 | 2 X 4 | 8 | 2 | 4 | A,B | 2:1 | 32 |
| ±4° X ±2° | 16 | 2 X 4 | 8 | 2 | 4 | A | 2:1 | 16 |
| ±2° X ±2° | 32 | 4 X 4 | 4 | 1 | 4 | A,B | -- | 0 |
| ±2° X ±2° | 16 | 4 X 4 | 4 | 1 | 4 | A | -- | 0 |

SCALEABLE ANTENNA ARRAY ARCHITECTURE USING STANDARD RADIATING SUBARRAYS AND AMPLIFYING/BEAMFORMING ASSEMBLIES

FIELD OF THE INVENTION

The present invention relates to a scaleable modular antenna array that uses standard subarrays and circuit assemblies.

BACKGROUND OF THE INVENTION

Satellite communications have become an important component in worldwide telecommunications. As the demand for satellite communications increases, the need for communications satellites that are less expensive and quicker to develop also increases. One approach to providing such communications satellites is described in U.S. Pat. No. 5,666,128 to Murray et al., which describes an array antenna especially adapted for spacecraft use that includes a support frame made up of intersecting beams which form an "egg-crate" of square openings and a plurality of subarrays or radiating tiles that are dimensioned to fit within the openings. There are limitations to this approach as applied to millimeter wave frequencies. One limitation is that the gaps between the radiating tiles become too large, in wavelengths at the frequency of interest, to achieve acceptable beam quality. The gaps between tiles are required to provide space for the support frame. Another limitation is based on the fact that, for a given coverage area, the quantity of phase shifters per radiating tile per radiated or received beam is proportional to the square of the frequency. At millimeter wave frequencies (~30 GHz), there is inadequate space in a tile to package the components required to create the number of radiated or received beams that are desired in many applications.

What is needed is a phased array antenna design that is modular and scaleable in terms of beam quantity, coverage area, and receive sensitivity/transmit effective isotropic radiated power (EIRP), which permits the design to be tailored to specific applications relatively inexpensively, quickly, and with low development risk.

SUMMARY OF THE INVENTION

The present invention is a phased array antenna design that is modular and scaleable in terms of beam quantity, coverage area, and receive sensitivity/transmit EIRP, which permits the design to be tailored to specific applications relatively inexpensively, quickly, and with low development risk. This invention can be applied to both transmit and receive phased array antenna applications.

In one embodiment of the present invention, a modular array building block for an antenna array comprises: a plurality of antenna elements, each antenna element operable to receive and output an electromagnetic wave signal, the antenna elements arranged adjacent to each other, a plurality of antenna element interface assemblies; each antenna element interface assembly coupled to one of the plurality of antenna elements and coupling the received signal to an amplifier, and a plurality of circuit board assemblies, the circuit board assemblies arranged substantially parallel to each other, each circuit board assembly comprising: a plurality of amplifiers, each amplifier operable to amplify a received signal from an antenna element, and a plurality of beamformers, each beamformer coupled to an output of an amplifier, wherein the circuit board assemblies, antenna element interface assemblies and antenna elements are arranged so as to form a module.

In one aspect of the present invention, the antenna elements are arranged adjacent to each other so as to form a grid pattern, such as a triangular grid pattern or a rectangular grid pattern.

In one aspect of the present invention, at least some of the circuit boards are populated with fewer amplifiers and beamformers than could be accommodated.

In one aspect of the present invention, the antenna elements are arranged so as to form a plurality of rows and the antenna elements and antenna element interfaces are oriented oppositely in adjacent rows. The circuit boards may have non-uniform spacing within the module. The antenna element interface assemblies may comprise waveguide assemblies.

In one aspect of the present invention, the antenna elements are arranged so as to form a plurality of rows and the antennas and antenna element interface assemblies are oriented similarly in adjacent rows. The circuit boards may have uniform spacing within the module. The antenna element interface assemblies may comprise waveguide assemblies.

In one aspect of the present invention, each antenna element interface assembly comprises a waveguide assembly. Each waveguide assembly may further comprise a waveguide filter. Each waveguide assembly further may comprise a signal probe operable to convert an electromagnetic wave signal from the antenna to a corresponding electrical signal and output the electrical signal to the amplifier.

In one aspect of the present invention, the module comprises larger antenna elements and a correspondingly smaller number of circuit board assemblies, larger antenna elements and correspondingly less populated circuit board assemblies, larger antenna elements and a correspondingly smaller number of less populated circuit board assemblies, smaller antenna elements and a correspondingly larger number of circuit board assemblies, smaller antenna elements and correspondingly more populated circuit board assemblies, or smaller antenna elements and a correspondingly larger number of more populated circuit board assemblies.

In one aspect of the present invention, the beamformers are radio frequency beamformers.

In one aspect of the present invention, the beamformers are intermediate frequency beamformers.

In one aspect of the present invention, connections between the plurality of amplifiers and the plurality of beamformers are interleaved so that if a number of amplifiers are omitted from a circuit board assembly, at least one beamformer can be omitted from the circuit board assembly In one embodiment of the present invention, a modular array building block for an antenna array comprises: a plurality of antenna elements, each antenna element operable to transmit an electromagnetic wave signal, the antenna elements arranged adjacent to each other, a plurality of antenna element interface assemblies; each antenna element interface assembly coupled to one of the plurality of antenna elements and coupling the signal from an amplifier, and a plurality of circuit board assemblies, the circuit board assemblies arranged substantially parallel to each other, each circuit board assembly comprising: a plurality of amplifiers, each amplifier operable to amplify a signal coupled to an antenna element, and a plurality of beamformers, each beamformer coupled to an input to an amplifier, wherein the circuit board assemblies, antenna element interface assemblies and antenna elements are arranged so as to form a module.

In one embodiment of the present invention, an antenna array comprises: a plurality of antenna array modules interlocking so as to form a contiguous antenna array structure, wherein each antenna array module comprises: a plurality of antenna elements, each antenna element operable to receive and output an electromagnetic wave signal, the antenna elements arranged adjacent to each other, a plurality of antenna element interface assemblies; each antenna element interface assembly coupled to one of the plurality of antennas and coupling the received signal to an amplifier; and a plurality of circuit board assemblies, the circuit board assemblies arranged substantially parallel to each other, each circuit board assembly comprising: a plurality of amplifiers, each amplifier operable to amplify a received signal from an antenna element, and a plurality of beamformers, each beamformer coupled to an output of an amplifier, wherein the circuit board assemblies, antenna element interface assemblies and antenna elements are arranged so as to form a module. Signal frequency, control, and DC power harnesses are used to electrically connect the antenna array modules to form an antenna array. The signal frequency selected for beamforming and power combining may either be the radio frequency (RF) or an intermediate frequency (IF) frequency.

In one embodiment of the present invention, an antenna array comprises: a plurality of antenna array modules interlocking so as to form a contiguous antenna array structure, wherein each antenna array module comprises: a plurality of antenna elements, each antenna element operable to transmit an electromagnetic wave signal, the antenna elements arranged adjacent to each other, a plurality of antenna element interface assemblies; each antenna element interface assembly coupled to one of the plurality of antennas and coupling the signal from an amplifier, and a plurality of circuit board assemblies, the circuit board assemblies arranged substantially parallel to each other, each circuit board assembly comprising: a plurality of amplifiers, each amplifier operable to amplify a signal coupled to an antenna element, and a plurality of beamformers, each beamformer coupled to an input to an amplifier, wherein the circuit board assemblies, antenna element interface assemblies and antenna elements are arranged so as to form a module. Signal frequency, control, and DC power harnesses are used to electrically connect the antenna array modules to form an antenna array. The signal frequency selected for beamforming and power dividing may either be the RF frequency or an IF frequency.

In one embodiment of the present invention, an antenna array comprises: a plurality of antenna array modules interlocking so as to form a contiguous antenna array structure, wherein each antenna array module comprises: a plurality of antenna elements, each antenna element operable to receive and output an electromagnetic wave signal and to transmit an electromagnetic wave signal, the antenna elements arranged adjacent to each other; a plurality of antenna element interface assemblies, each antenna element interface assembly coupled to one of the plurality of antenna elements and coupling the received signal to a receive amplifier and coupling the signal to be transmitted from a transmit amplifier; and a plurality of circuit board assemblies, the circuit board assemblies arranged substantially parallel to each other, each circuit board assembly comprising: a plurality of receive amplifiers, each receive amplifier operable to amplify a received signal from an antenna element, a plurality of transmit amplifiers, each amplifier operable to amplify a signal coupled to an antenna element, a plurality of beamformers, each beamformer coupled to an input to a transmit amplifier and coupled to an output of a receive amplifier, a plurality of duplexing devices coupling a transmit amplifier output and a receive amplifier input to an antenna element interface assembly, a plurality of duplexing devices coupling each beamformer to a transmit amplifier input and to a receive amplifier output; wherein the circuit board assemblies, antenna element interface assemblies and antenna elements are arranged so as to form a module; and signal frequency, control, and DC power harnesses to electrically connect the plurality of antenna array modules so as to form the antenna array. The signal frequency selected for beamforming and power dividing/combining may either be the RF frequency or an IF frequency.

BRIEF DESCRIPTION OF THE DRAWINGS

The details of the present invention, both as to its structure and operation, can best be understood by referring to the accompanying drawings, in which like reference numbers and designations refer to like elements.

FIG. 8 is a table summarizing a number of exemplary arrangements of array modules.

DETAILED DESCRIPTION OF THE INVENTION

The present invention is a phased array antenna design that is modular and scaleable in terms of beam quantity, coverage area, and receive sensitivity/transmit EIRP, which permits the design to be tailored to specific applications relatively inexpensively, quickly, and with low development risk.

Figure 1:
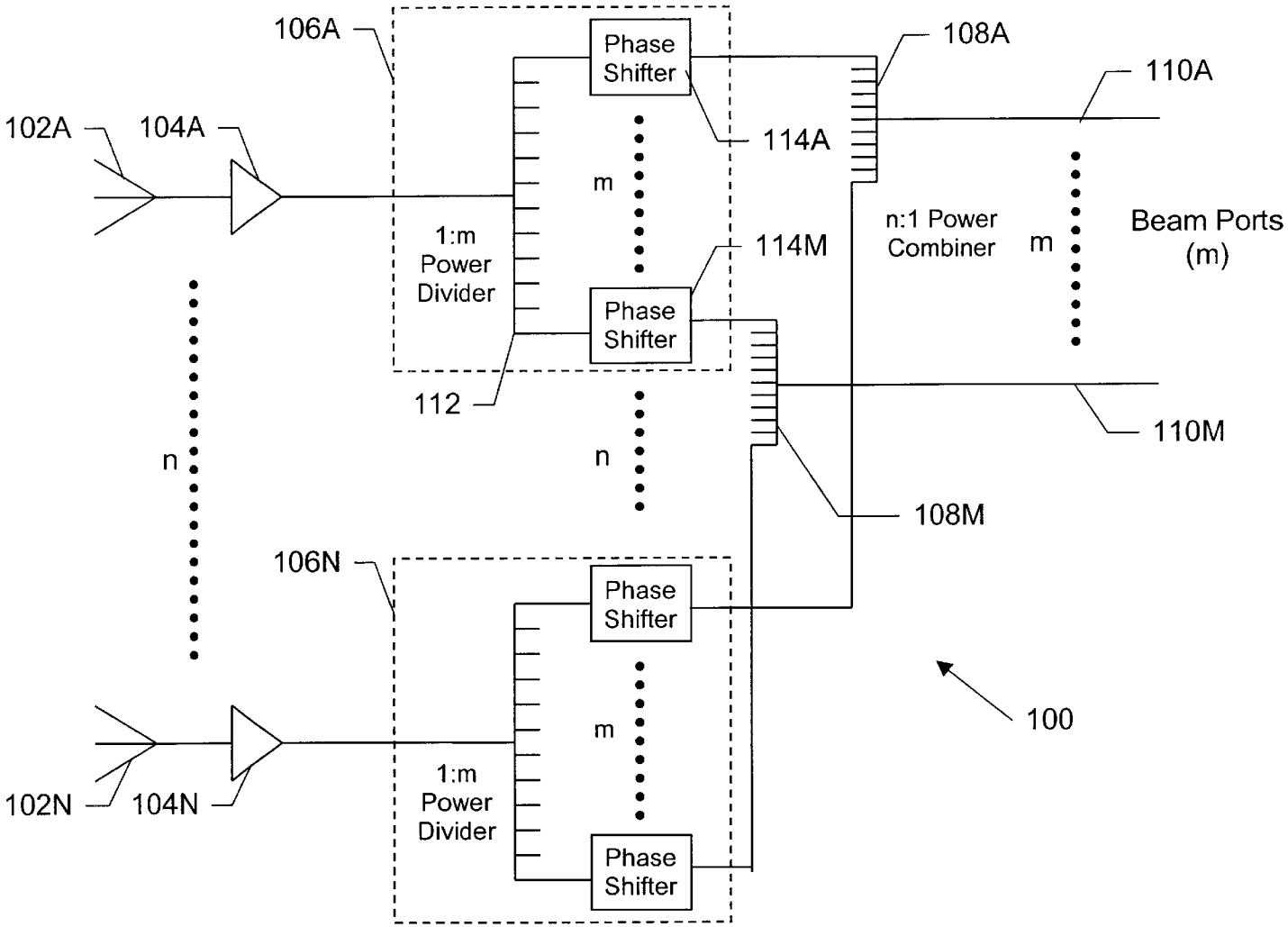
FIG. 1 is a schematic diagram of a circuit of a phased array receiving system, according to the present invention.

A schematic diagram of a circuit 100 of a phased array receiving system, according to the present invention, is shown in FIG. 1. System 100 includes a plurality of antenna element assemblies 102A–102N, a plurality of low noise 104A–104N, a plurality of beamformers 106A–106N, a plurality of power combiners 108A–108M, and a plurality of beam ports 110A–110M. For clarity of description, the number of antenna element assemblies is designated as "n". Antenna element assemblies 102A–102N are arranged to form a two dimensional antenna array. Each antenna element assembly, such as antenna element assembly 102A, receives a radio frequency (RF) electromagnetic wave signal and converts it to a corresponding electrical signal, which is output from the antenna element assembly to a low noise amplifier. Typically, an antenna element assembly includes a receiving antenna element, such as a horn or waveguide slot antenna element, one or more waveguides, filters, signal probes, etc. The input of each low noise amplifier (LNA) is connected to the output of one antenna element assembly. Thus, if there are n antenna element assemblies, there are n LNAs as well. The LNA receives the electrical signal output from the connected antenna element assembly and amplifies the electrical signal. For example, the input of LNA 104A is connected to the output of antenna element assembly 102A and LNA 104A receives and amplifies the electrical signal output from antenna element assembly 102A.

In a preferred embodiment, waveguides are used to interface antenna elements to the remaining circuitry. However, it is to be noted that a waveguide is merely one example of an antenna element interface assembly. Other examples may include coaxial cable assemblies or fiber optic assemblies. Although, in this specification, waveguides are used as examples of antenna element interface assemblies, the present invention contemplates any and all embodiments of antenna element interface assemblies.

The output of each LNA is connected to the input of a beamformer. Thus, there are n beamformers. For example, the output of LNA 104A is connected to the input of beamformer 106A. Each beamformer includes a power divider and a plurality of phase shifters. For example, beamformer 106A includes power divider 112 and phase shifters 114A–114M. Power divider 112 divides the signal input to beamformer 106A into a plurality of signals of nominally equal power, which are output from the plurality of outputs of power divider 112. For clarity of description, the number of signals into which power divider 112 divides the input signal, which is equal to the number of outputs from power divider 112 and to the number of phase shifters in the beamformer, is designated "m". As power divider 112 has one input and m outputs, it may be designated a "1:m" power divider.

Each output of power divider 112 is connected to the input of a corresponding phase shifter 114A–114M. Each phase shifter shifts its input signal by a predetermined phase angle, which may be different for each phase shifter in a given beamformer. Each beamformer has a plurality of outputs, each output being an output from one of the phase shifters included in the beamformer. For example, beamformer 106A has a plurality of outputs, each output being an output from a phase shifter 114A–M. As there are n beamformers 106A–106N and each beamformer has m outputs, the total number of outputs from all beamformers is n * m.

Each output of a beamformer 106A–106N is connected to an input of a power combiner 108A–108M. Each power combiner has n inputs, which is equal to the number of antenna element assemblies, LNAs, and beamformers.

Thus, each power combiner 108A–108M may be designated an "n:l" power combiner. There are m power combiners, which is equal to the number of phase shifters in each beamformer 106A–106N. Each input of each power combiner 108A–108M is connected to the output of one phase shifter from each beamformer 106A–106N. Each power combiner combines the input signals to form a single output signal. As there are m power combiners 108A–108M, there are m signals output from power combiners 108A–108M. The outputs from power combiners 108A–108M are beam ports 110A–110M.

The phase shifters are used to electronically steer the beams created by the antenna array. A beam may be pointed in different directions by resetting the phase shifts of all of the phase shifters associated with that beam.

Figure 2:
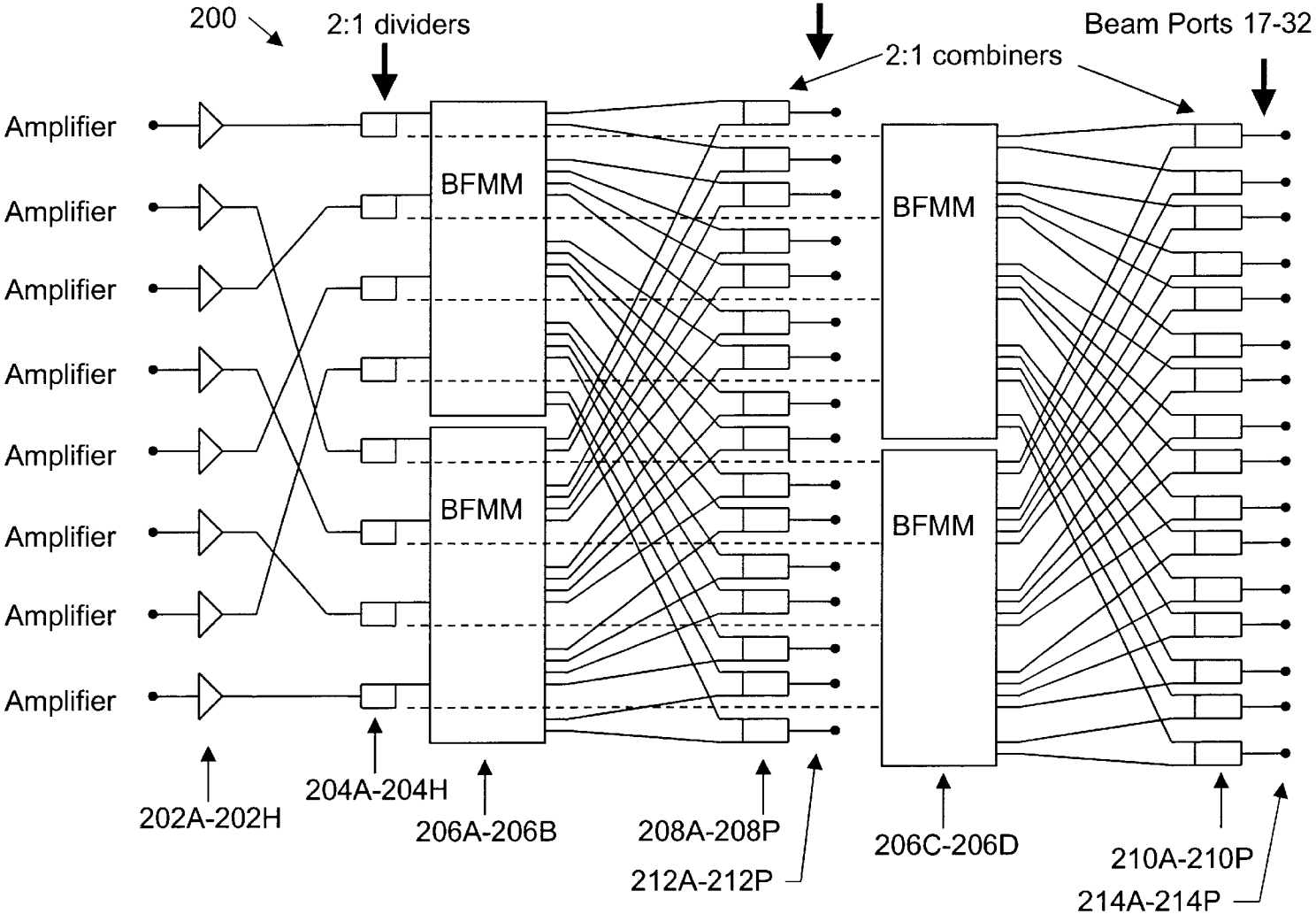
FIG. 2 is a block diagram of an embodiment of an amplifier/beamformer matrix module board used in a phased array receiving system, according to the present invention.

A block diagram of a preferred embodiment of an amplifier/beamformer matrix module board 200 used in a phased array receiving system, according to the present invention, is shown in FIG. 2. Board 200 includes a plurality of low noise amplifiers (LNAs) 202A–202H, power dividers 204A–204H, beamformer matrix modules (BFMM) 206A, 206B, 206C, and 206D, power combiners 208A–208P and 210A–210P, and beam ports 212A–212P and 214A–214P. Each BFMM has four input ports. Each input port connects to a 1:16 power divider, which, in turn, connects to 64 phase control circuits. The phase control circuits are connected through 16 4:1 power combiners to 16 output ports.

Each LNA 202A–202H is connected to the output of an antenna element assembly (not shown). In the preferred embodiment shown in FIG. 2, there are provisions for eight LNAs on each board 200. The output from each LNA 202A–202H is connected to a power divider. For example, the output of LNA 202A is connected to the input of power divider 204A. As there are provisions for eight LNAs 202A–202H, there are likewise provisions for eight power dividers 204A–204H.

In the preferred embodiment shown in FIG. 2, each power divider 204A–204H is a 2:1 power divider. That is, each power divider 204A–204H has one input and two outputs. Each output of each power divider 204A–204H is connected to an input of a BFMM. For example, one output of power divider 204A is connected to an input of BFMM 206A and the other output of power divider 204A is connected to an input of BFMM 206C (connection shown as a dashed line).

The connections of the outputs of power dividers associated with LNAs to inputs of BFMMs are interleaved. That is, the outputs of power dividers connected to adjacent LNAs are connected to inputs of alternate sets of BFMMs. Thus, the outputs of power divider 204A, which is connected to LNA 202A, are connected to inputs to the set of BFMMs including BFMM 206A and BFMM 204C, while the outputs power divider 204B, which is connected to adjacent LNA 202B, are connected to inputs to the set of BFMMs including BFMM 206B and BFMM 206D. As a result, each BFMM is coupled to alternate LNAs.

The outputs from each BFMM 206A–206D are connected to inputs of power combiners. In the preferred embodiment shown in FIG. 2, each BFMM 206A–206D has sixteen outputs and each power combiner 208A–208P and 210A–210P is a 2:1 combiner and has two inputs and one output. The inputs of the power combiners are interleaved between the BFMMs. For example, one input of power combiner 208A is connected to an output from BFMM 206A, which is in the set of BFMMs including BFMM 206A and BFMM 204C, and the other output of power combiner 208A is connected to an output from BFMM 206B, which is in the set of BFMMs including BFMM 206B and BFMM 206D. Likewise, one input of power combiner 210A is connected to an output from BFMM 206C, which is in the set of BFMMs including BFMM 206A and BFMM 204C, and the other output of power combiner 210A is connected to an output from BFMM 206D, which is in the set of BFMMs including BFMM 206B and BFMM 206D. The outputs of the power combiners 208A–208P and 210A–210P form beamports 212A–212P and 214A–214P.

Figure 3:
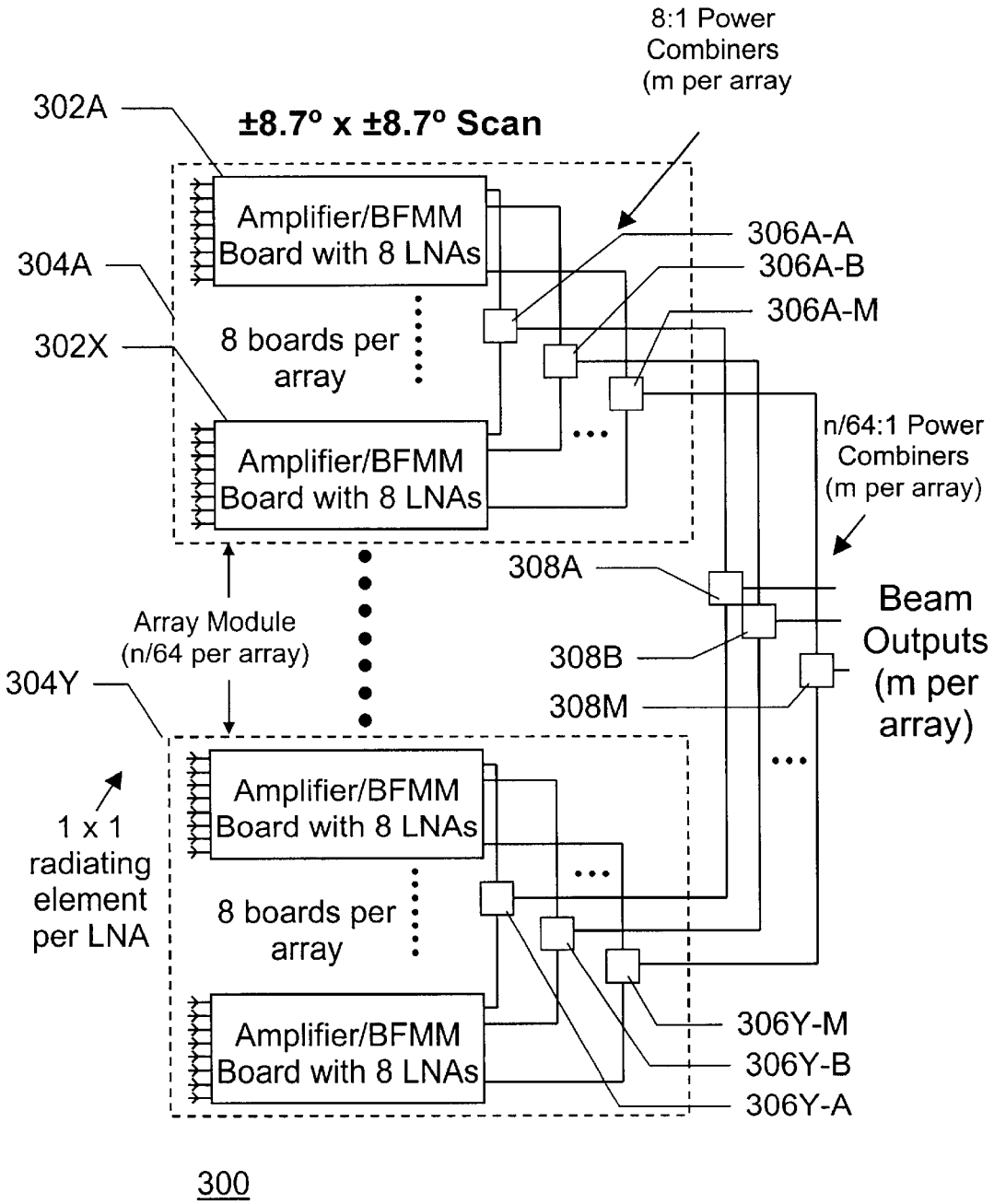
FIG. 3 is a block diagram showing an example of a plurality of amplifier/beamformer matrix module boards, shown in FIG. 2, combined to form a phased array receiving system.

A plurality of amplifier/beamformer matrix module boards 200, shown in FIG. 2, are combined to form a phased array receiving system, such as phased array receiving system 300, shown in FIG. 3. As shown in FIG. 3, a plurality of amplifer/BFMM boards, such as boards 302A–302X are arranged in an array module, such as array module 304A. A plurality of array modules, such as array modules 304A–304Y are arranged to from the phased array receiving system.

The outputs from the plurality of amplifer/BFMM boards 302A–302X, which are beamports, such as beamports 212A–212P and 214A–214P, shown in FIG. 2, are connected to a plurality of power combiners, such as power combiners 306A-A through 306A-M. For example, outputs from amplifer/BFMM boards 302A–302X are connected to the inputs to power combiner 306A-A, while different outputs from amplifer/BFMM boards 302A–302X are connected to the inputs to power combiner 306A-B, etc. The outputs from the power combiners of each array module, such as modules 304A–304Y, are connected to the inputs to a plurality of power combiners, such as power combiners 308A–308M. For example, the outputs of power combiners 306A-A through 306Y-A are connected to inputs of power combiner 308A. Likewise, the outputs of power combiners 306A-M through 306Y-M are connected to inputs of power combiner 308M. The outputs from power combiners 308A–308M are the beam outputs from the phased array receiving system.

The exemplary system shown in FIG. 3 is arranged to provide a scan coverage of ±8.7° (elevation)×±8.7° (azimuth), which would be suitable for global coverage for a Geostationary communications satellite. In this example, the antenna elements that are connected to the amplifier/BFMM boards are 1×1 antenna elements, which provide the scan coverage of ±8.7°×±8.7°. As shown in FIG. 2, in a preferred embodiment, there are provisions for up to eight antenna elements to be connected to an amplifier/BFMM board. In the example shown in FIG. 3, there are eight antenna elements connected to each amplifier/BFMM board and there are eight amplifier/BFMM boards in each array module 304A 304Y. Thus, there are 64 antenna elements in each array module 304X–304Y. As there are eight amplifier/BFMM boards in each array module, each power combiner, such as power combiner 306A-A, is an 8:1 power combiner having eight inputs. Each input is connected to a different amplifier/BFMM board.

The number of array modules in the phased array receiving system is dependent upon engineering factors, such as the size and weight capacity of the satellite platform, the available power, the necessary antenna gain, etc., and upon cost factors. The necessary antenna gain determines the number of antenna elements that are required. In the example shown in FIG. 3, the total number of antenna elements is designated "n". As there are 64 antenna elements per array module, the number of array modules is n/64. The amplifier/BFMM boards in each array module each have a number of outputs designated "m". There are then m outputs from each array module and m power combiners 308A–308M. Each power combiner, such as power combiner 308A, has one input per array module, or n/64 inputs and is an n/64:1 power combiner. The phased array receiving system thus has m beam outputs.

Figure 4:
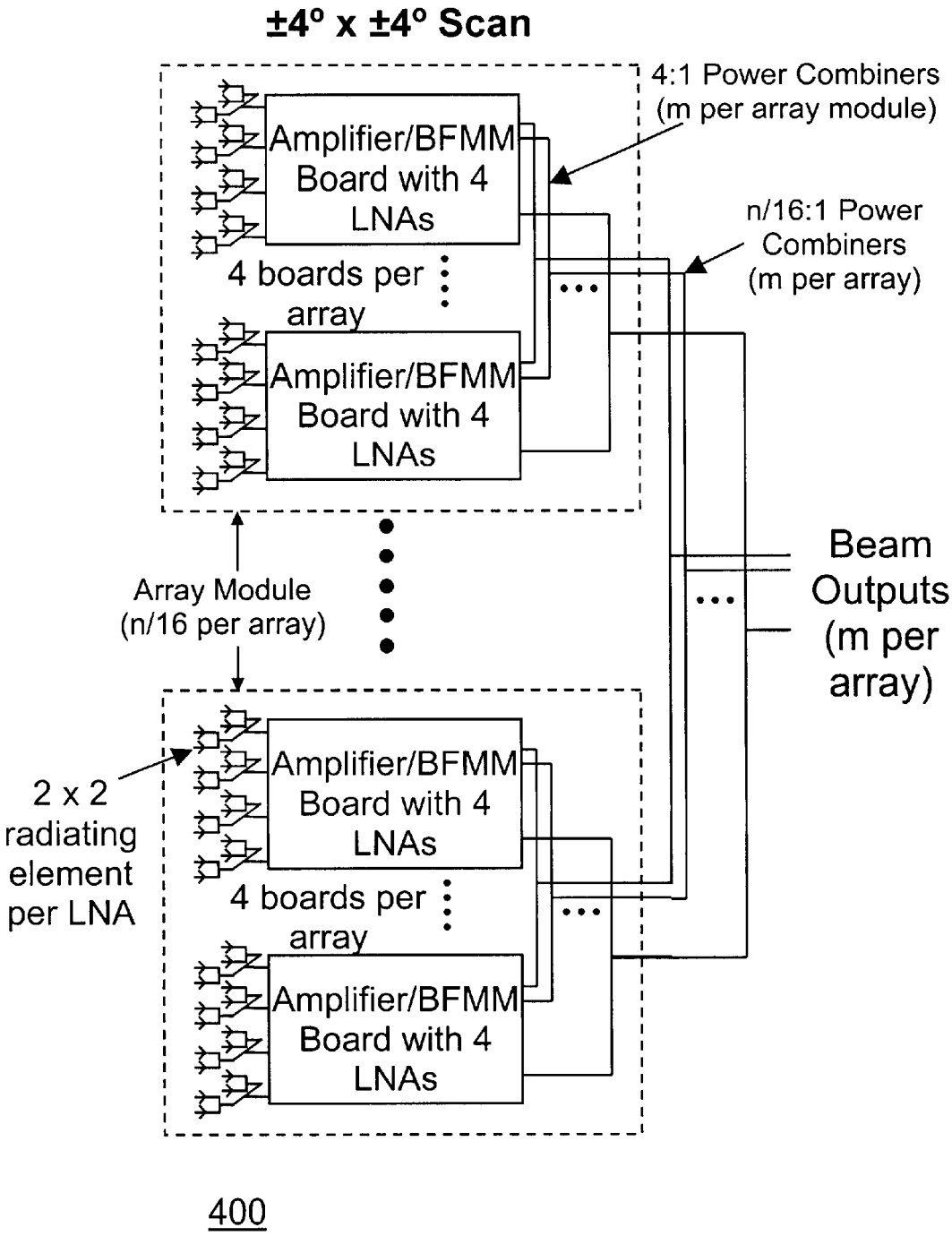
FIG. 4 is a block diagram showing an example of a plurality of amplifier/beamformer matrix module boards, shown in FIG. 2, combined to form a phased array receiving system.

An example of a phased array receiving system that is arranged to provide a scan coverage of ±4°×±4°. As shown in FIG. 4. This scan range covers nearly one quarter of the surface of the earth, as seen by a geostationary communications satellite. In this example, the antenna elements that are connected to the amplifier/BFMM boards are 2×2 antenna elements, which provide the scan coverage of ±4°×±4°. As shown in FIG. 2, in a preferred embodiment, there are provisions for up to eight antenna elements to be connected to an amplifier/BFMM board. In the example shown in FIG. 4, there are four antenna elements connected to each amplifier/BFMM board and there are four amplifier/BFMM boards in each array module 304A–304Y. In comparison to the configuration shown in FIG. 3, four complete amplifier/BFMM boards are omitted. Also, the four remaining amplifier/BFMM boards are only populated with four LNAs (202A, 202C, 202E, and 202G) and two BFMMs (206A and 206C). Four LNAs (202B, 202D, 202F, and 202H) and two BFMMs (206B and 206D) are omitted. These changes result in a substantial reduction in mass, power consumption, and cost and can be achieved without redesigning the amplifier/BFMM board. There are 16 antenna elements in each array module 304A–304Y. As there are four amplifier/BFMM boards in each array module, each power combiner, such as power combiner 306A-A, is a 4:1 power combiner having four inputs. Each input is connected to a different amplifier/BFMM board.

The number of array modules in the phased array receiving system is dependent upon engineering factors, such as the size and weight capacity of the satellite platform, the available power, the necessary antenna gain, etc., and upon cost factors. The necessary antenna gain determines the number of antenna elements that are required. In the example shown in FIG. 4, the total number of antenna elements is designated "n". As there are 16 antenna elements per array module, the number of array modules is n/16. The amplifier/BFMM boards in each array module each have a number of outputs designated "m". There are then m outputs from each array module and m power combiners 308A–308M. Each power combiner, such as power combiner 308A, has one input per array module, or n/16 inputs and is an n/16:1 power combiner. The phased array receiving system thus has m beam outputs.

Figure 5:
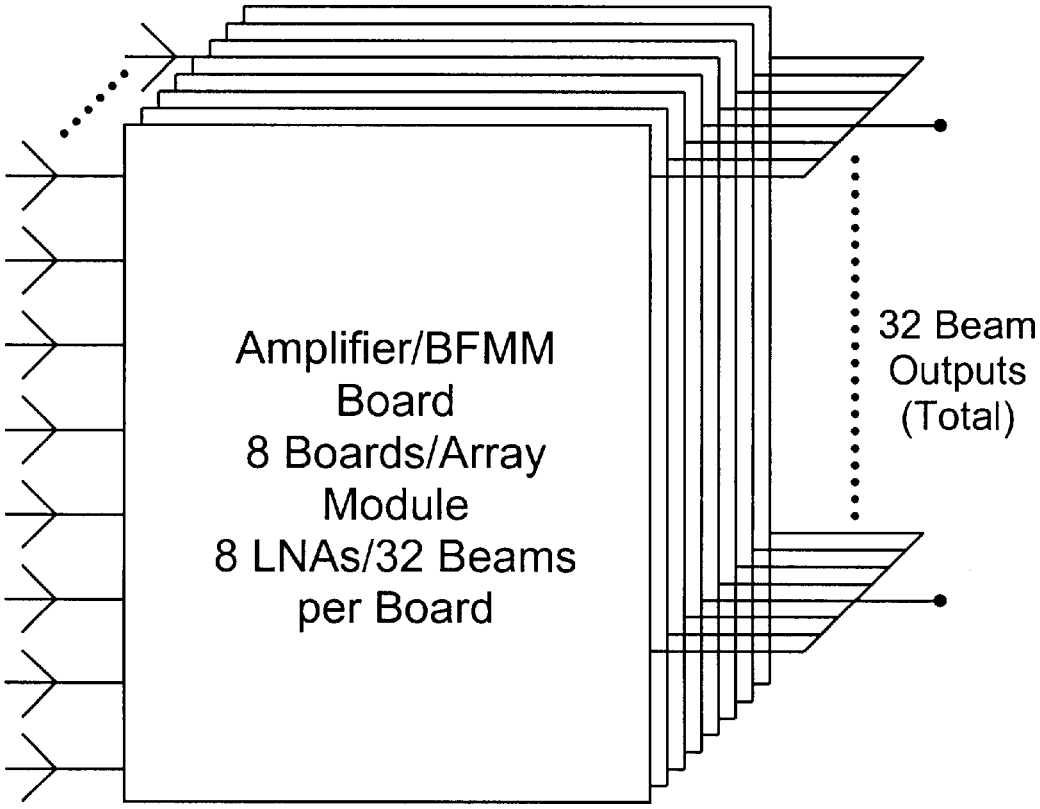
FIG. 5 is an example of the physical arrangement of amplifier/BFMM boards that form an array module.

An example of the physical arrangement of amplifier/BFMM boards that form an array module is shown in FIG. 5. In this example, eight amplifier/BFMM boards are arranged to form an array module. Each amplifier/BFMM boards has eight LNAs and generates 32 beams per board. Each LNA is connected to one antenna element, so there are eight antenna elements connected to each board, for total of 64 antenna elements.

Figure 6:
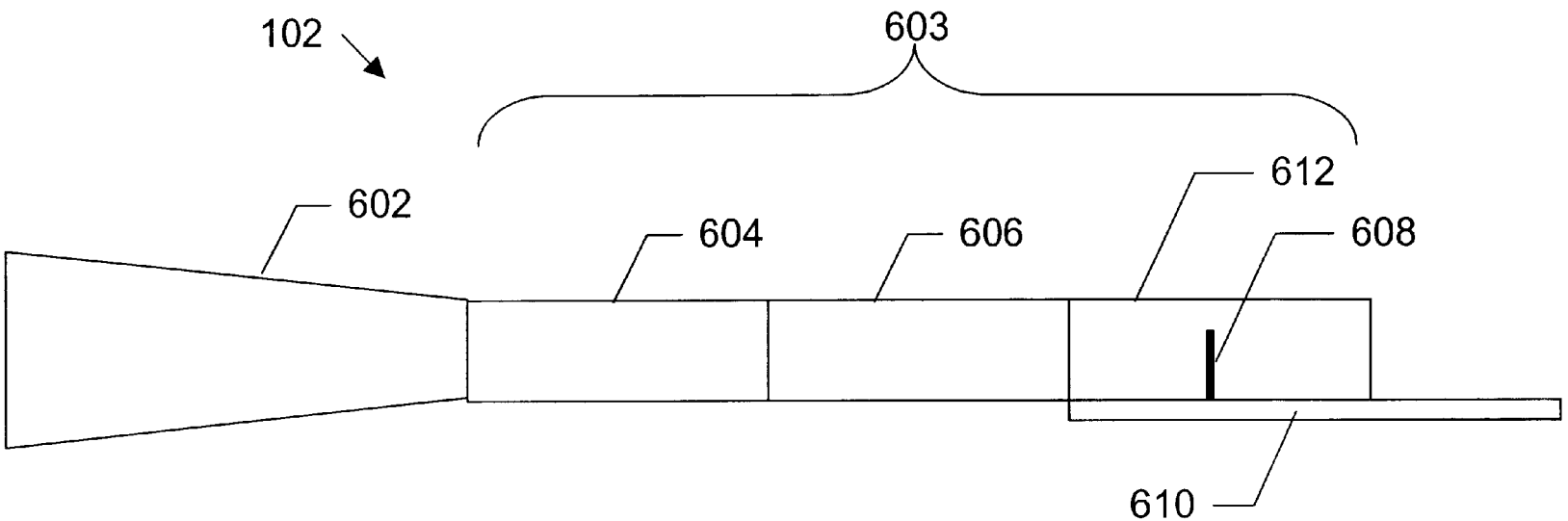
FIG. 6 is a block diagram of an antenna element assembly.

A block diagram of an exemplary antenna element assembly 102, shown in FIG. 1, is shown in FIG. 6. In this example, the antenna element is a horn radiator antenna structure. However, the present invention contemplates slot radiator antenna structures as well. Antenna element assembly 102 includes an antenna element 602 and waveguide assembly 603. Waveguide assembly 603 includes waveguide portion 604, waveguide filter 606, and signal probe 608. Antenna element 602 receives radio frequency (RF) electromagnetic wave signals and directs the signals to waveguide 604. Waveguide portion 604 channels the signals to waveguide filter 606. Waveguide filter 606 is a bandpass filter that attenuates frequencies other than the frequency band for which the antenna array is designed. The filtered signal is channeled to signal probe 608, which converts it to a corresponding electrical signal. The electrical signal is directed to circuit board 610, which contains half of the circuitry shown in FIG. 2.

Figure 7A:
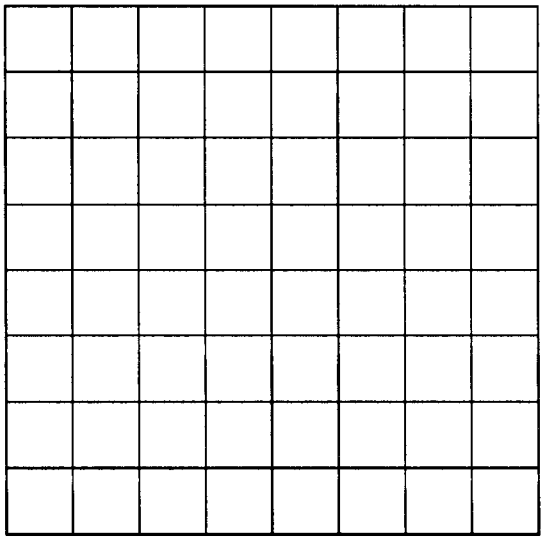
FIGS. 7*a*, 7*b*, 7*c*, 7*d*, 7*e*, 7*f*, 7*g*, 7*h*, and 7*i* are diagrams of examples of antenna element configurations.

The antenna elements used in the present invention may be characterized by their size in wavelengths at the frequency of interest, which is the frequency at which the antenna element is designed to transmit or receive. One typical antenna element configuration is termed a 1×1 antenna element or antenna element configuration. A 1×1 antenna element is approximately 2.1 wavelengths by 2.4 wavelengths in size. This asymmetric element provides substantially symmetric scan performance when a triangular grid is selected. This element provides a scan coverage of approximately ±8.7°×±8.7°. For a geostationary communications satellite, this scan supports global coverage. An example of an array module having 1×1 antenna elements is shown in FIG. 7*a*. As shown, there are 64 1×1 antenna elements in this example. The 64 antenna elements are connected to 64 LNAs, arranged as eight amplifier/BFMM boards with eight LNAs per board.

Figure 7B:
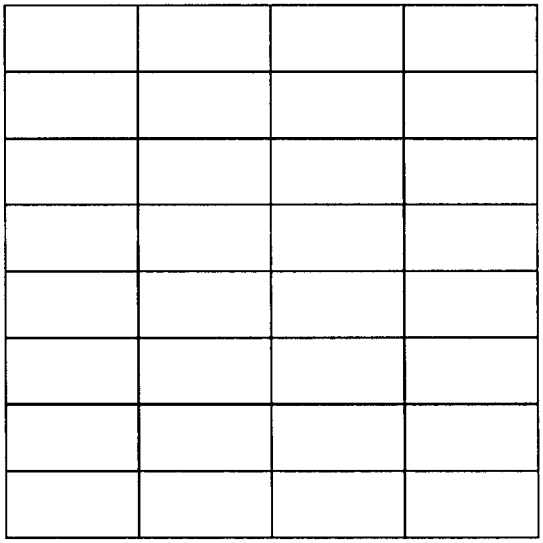

An example of an array module having 2×1 antenna elements is shown in FIG. 7*b*. A 2×1 antenna element is approximately 4.2 wavelengths by 2.4 wavelengths in size and provides a scan coverage of approximately±4°×±8.70°. This scan covers approximately half the viewable earth from geostationary orbit. As shown, there are 32 2×1 antenna elements in this example. The 32 antenna elements are connected to 32 LNAs, arranged as eight amplifier/BFMM boards with four LNAs per board.

Figure 7C:
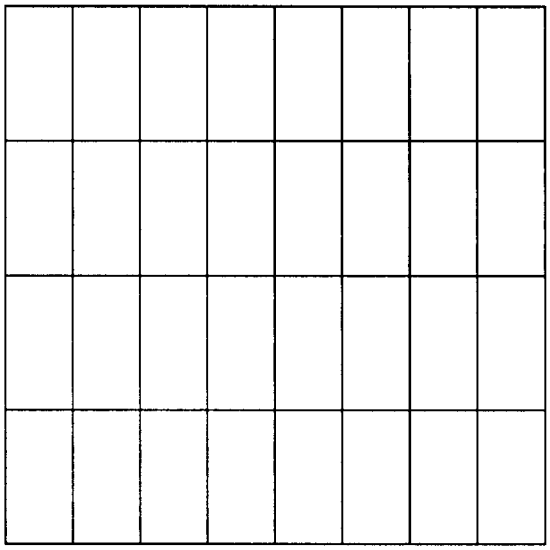

An example of an array module having 1×2 antenna elements is shown in FIG. 7*c*. A 1×2 antenna element is approximately 2.1 wavelengths by 4.8 wavelengths in size and provides a scan coverage of approximately±8.7°×±4°. As shown, there are 32 1×2 antenna elements in this example. The 32 antenna elements are connected to 32 LNAs, arranged as four amplifier/BFMM boards with eight LNAs per board.

Figure 7D:
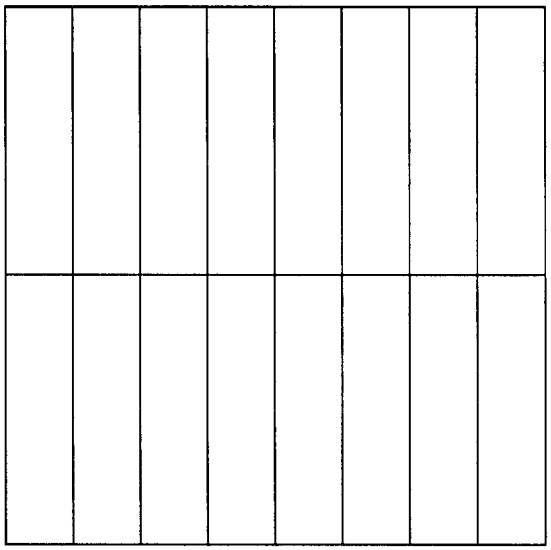

An example of an array module having 1×4 antenna elements is shown in FIG. 7*d* . *A* 1×4 antenna element is approximately 2.1 wavelengths by 9.6 wavelengths in size and provides a scan coverage of approximately±8.7°×±2°. As shown, there are 16 1×4 antenna elements in this example. The 16 antenna elements are connected to 16 LNAs, arranged as two amplifier/BFMM boards with eight LNAs per board.

Figure 7E:
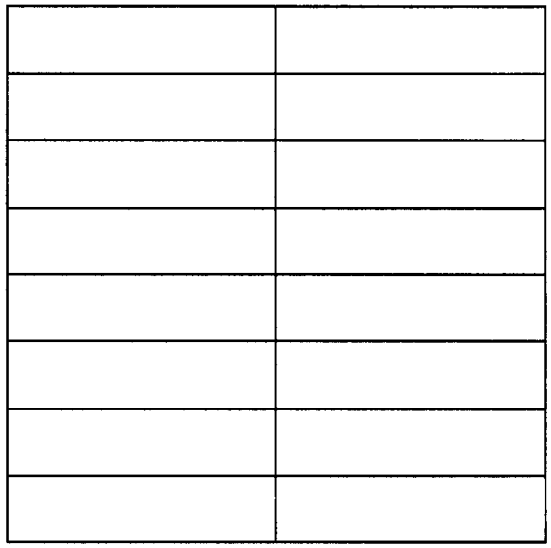

An example of an array module having 4×1 antenna elements is shown in FIG. 7*e*. A 4×1 antenna element is approximately 8.4 wavelengths by 2.4 wavelengths in size and provides a scan coverage of approximately±8.7°×±2°. As shown, there are 16 4×1 antenna elements in this example. The 16 antenna elements are connected to 16 LNAs, arranged as four amplifier/BFMM boards with four LNAs per board.

Figure 7F:
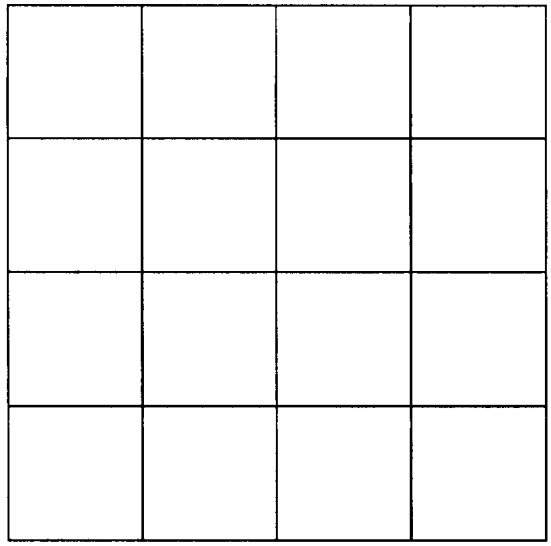

An example of an array module having 2×2antenna elements is shown in FIG. 7*f*. A 2×2antenna element is approximately 4.2 wavelengths by 4.8 wavelengths in size and provides a scan coverage of approximately±4°×±4°. As shown, there are 16 2×2antenna elements in this example. The 16 antenna elements are connected to 16 LNAs, arranged as four amplifier/BFMM boards with four LNAs per board.

Figure 7G:
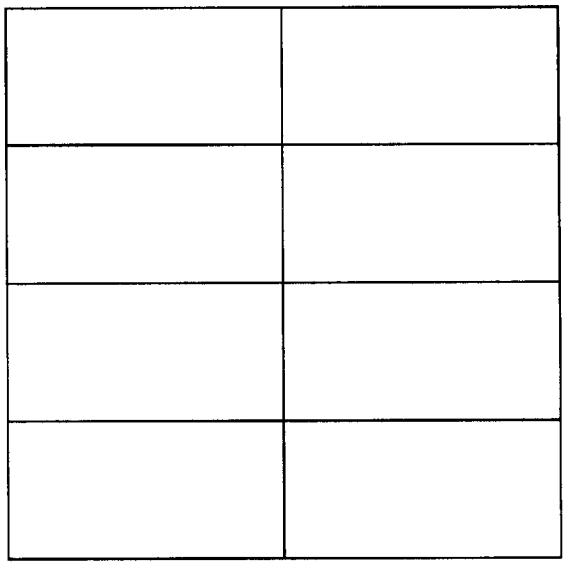

An example of an array module having 4×2 antenna elements is shown in FIG. 7*g*. A 4×2 antenna element is approximately 8.4 wavelengths by 4.8 wavelengths in size and provides a scan coverage of approximately±2°×±4°. As shown, there are eight 4×2 antenna elements in this example. The eight antenna elements are connected to eight LNAs, arranged as two amplifier/BFMM boards with four LNAs per board.

Figure 7H:
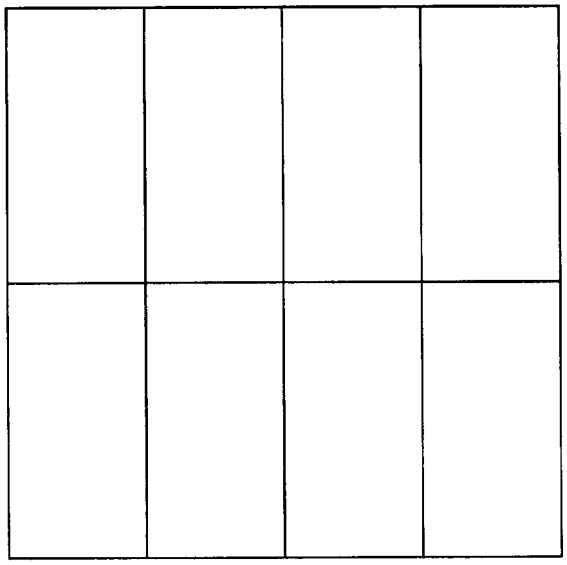

An example of an array module having 2×4 antenna elements is shown in FIG. 7*h*. A 2×4 antenna element is approximately 4.2 wavelengths by 9.6 wavelengths in size and provides a scan coverage of approximately±4°×±2°. As shown, there are eight 2×4 antenna elements in this example. The eight antenna elements are connected to eight LNAs, arranged as two amplifier/BFMM boards with four LNAs per board.

Figure 7I:
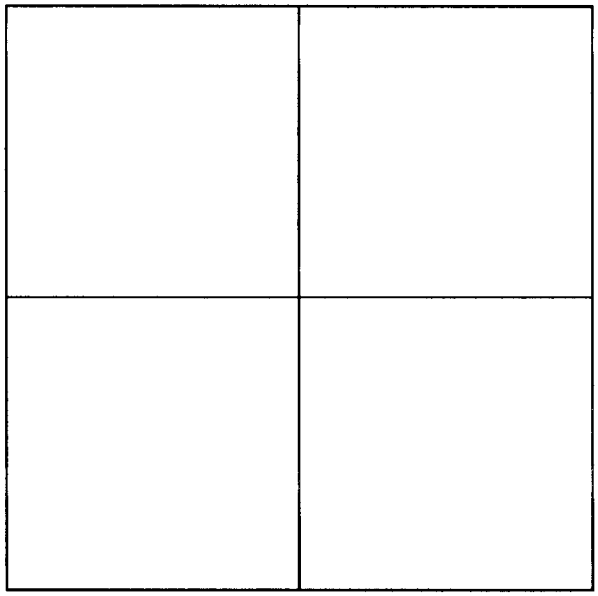

An example of an array module having 4×4 antenna elements is shown in FIG. 7*i*. A 4×4 antenna element is approximately 8.4 wavelengths by 9.6 wavelengths in size and provides a scan coverage of approximately±2°×±2°. As shown, there are four 4×4 antenna elements in this example. The four antenna elements are connected to four LNAs, arranged as one amplifier/BFMM board with four LNAs per board.

A number of exemplary arrangements of array modules are summarized in table 800, shown in FIG. 8. As shown, for each scan coverage requirement, there are two alternate embodiments available that can provide the same scan coverage. Within a particular scan coverage requirement, the embodiments differ in the beam quantity that they provide, and thus, differ in the quantities and locations of BFMMs that are used. Among scan coverage requirements, the embodiments differ in the type and quantity of antenna elements that are used and the quantities of amplifer/BFMM boards and beam combiners that are used. It will be seen that a very wide range of antenna capabilities can be provided using a relatively small range of standard parts. In this way, the design goal of providing scalability of coverage area and beam quantity with low development cost has been achieved.

There are several ways that particular antenna element configurations may be implemented. For example, a 2×2antenna element with a horn radiator may be implemented as a single horn of approximately 4.2 wavelengths by 4.8 wavelengths, or as four horns of approximately 2.1 wavelengths by 2.4 wavelengths. The choice of the particular implementation is an engineering decision, which may be made based on factors, such as size and weight of the antenna array, as well as cost. An example of a 2×2antenna element that is implemented as four horns of approximately 2.1 wavelengths by 2.4 wavelengths is shown in FIGS. 9*a–d*.

Figure 9A:
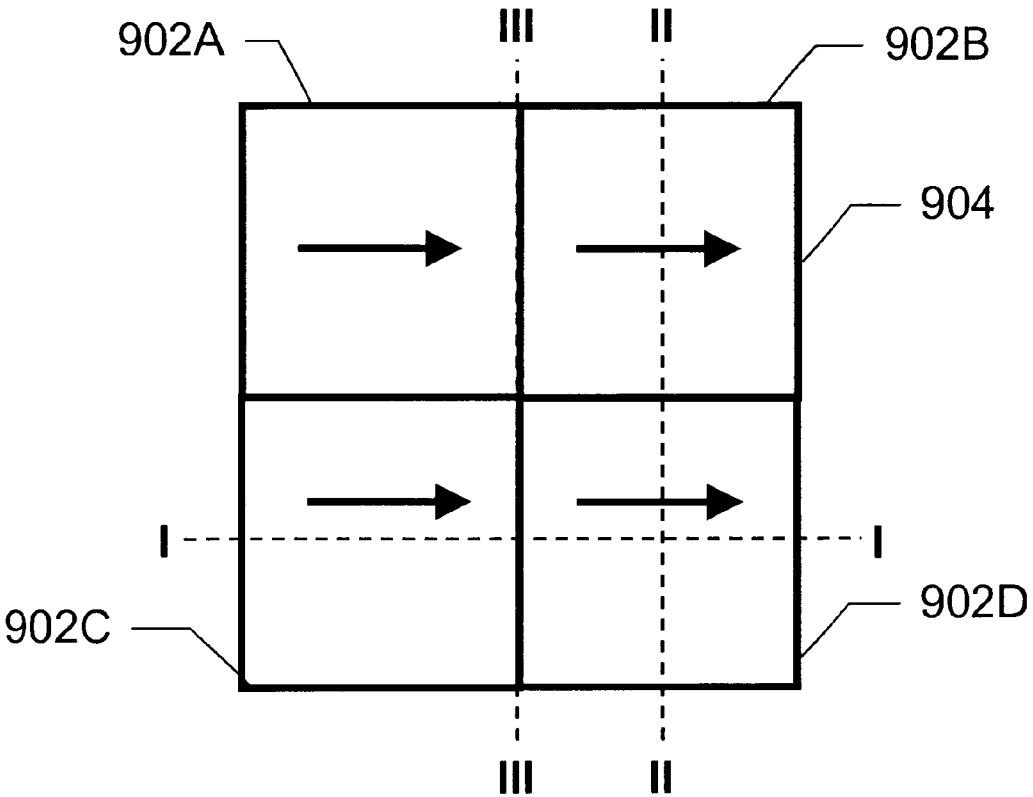
FIGS. 9*a*, 9*b*, 9*c*, and 9*d* is are diagrams showing a number of views of an exemplary antenna element.
Figure 9B:
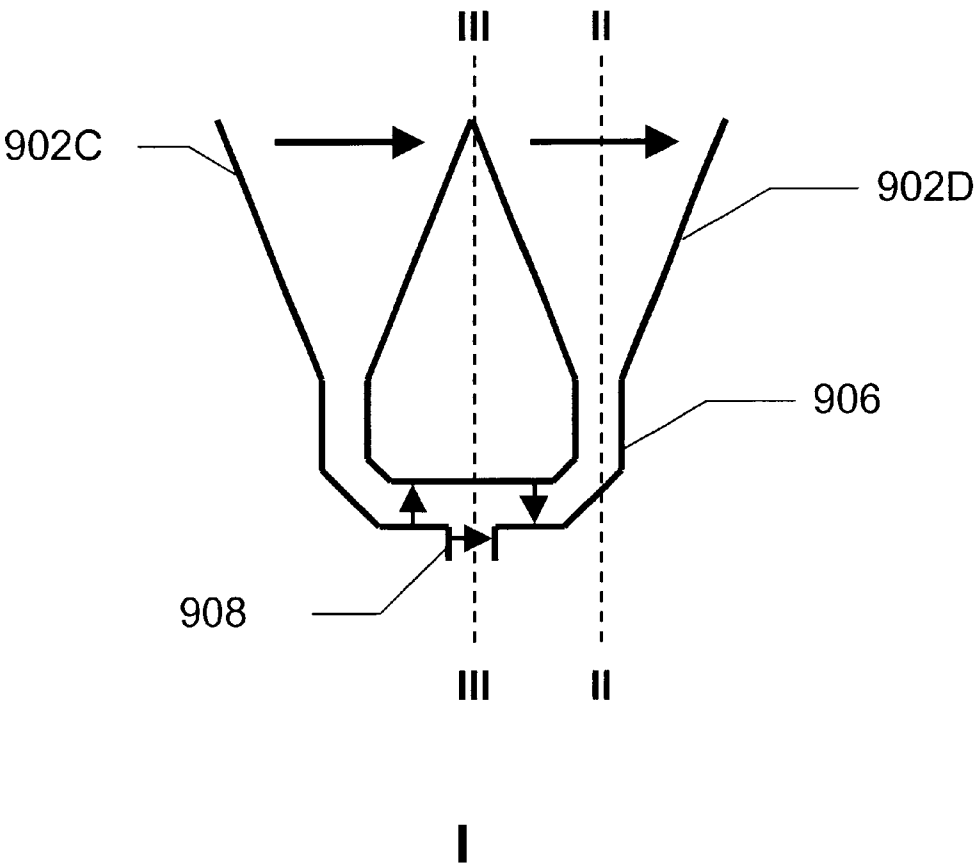
Figure 9C:
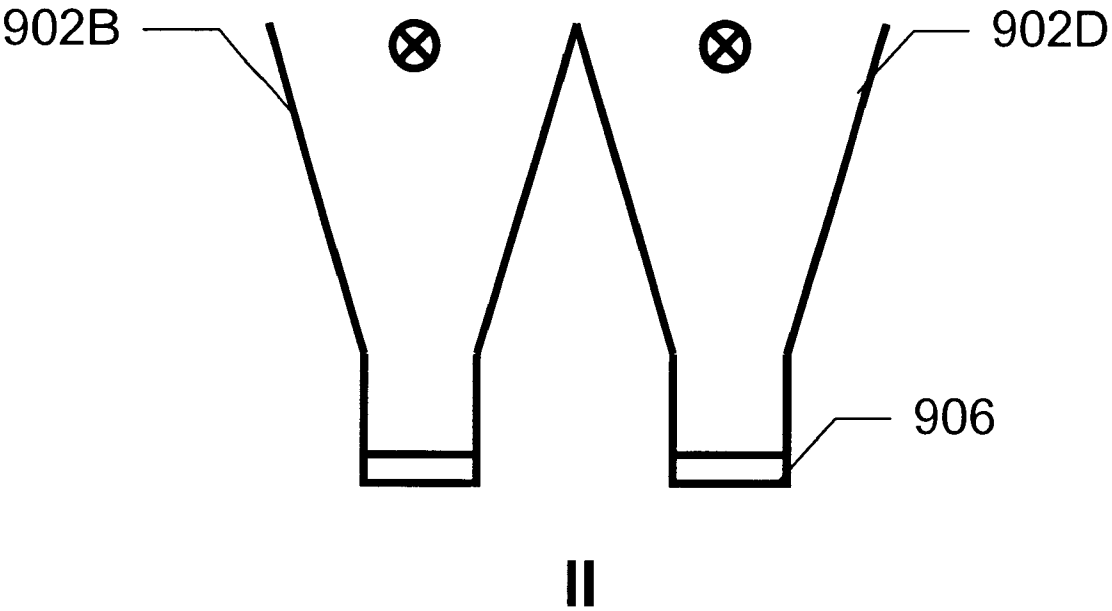
Figure 9D:
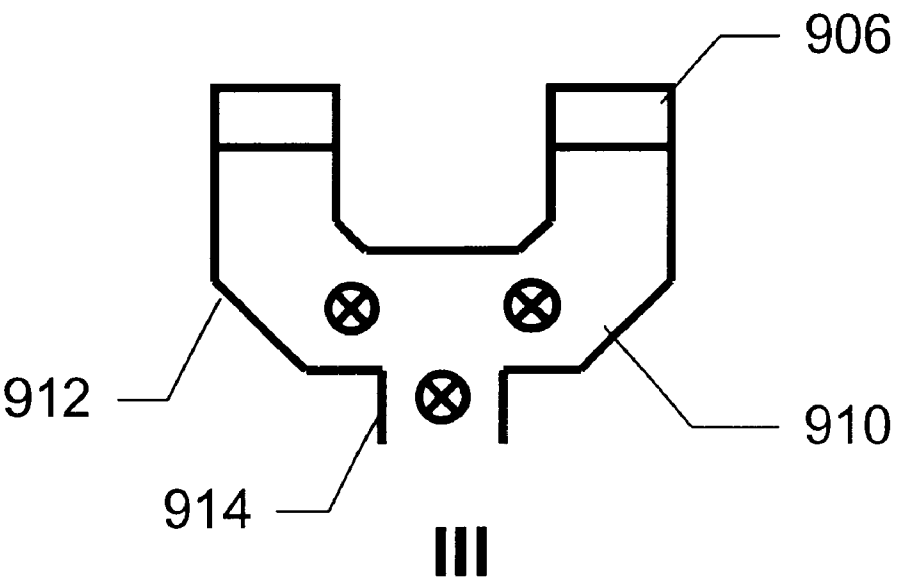

FIG. 9*a* shows a front view of a 2×2antenna element implemented as a combination of four radiators. In particular, radiators 902A, 902B, 902C, and 902D are combined to form a single 2×2antenna element 904. The direction of electrical field polarization in the radiators is shown by the arrows. A sectional view taken along plane "I" of FIG. 9*a* is shown in FIG. 9*b*. As shown, each pair of radiators, such as radiator pair 902C and 902D, are coupled by waveguides 906 to a power divider 908, which divides the signal power among the waveguides coupled to each radiator. A sectional view taken along plane "II" of FIGS. 9*a* and 9*b* is shown in FIG. 9*c*. As shown, each radiator, such as radiators 902B and 902D, are coupled to a single waveguide, such as waveguide 906. A sectional view taken along plane "III" of FIG. 9*a* is shown in FIG. 9*d*. As shown, each waveguide that couples a radiator pair, such as waveguide 906, is coupled by waveguides, such as waveguides 910 and 912, to a power divider 914, which divides the signal power among the waveguides.

Figure 10:
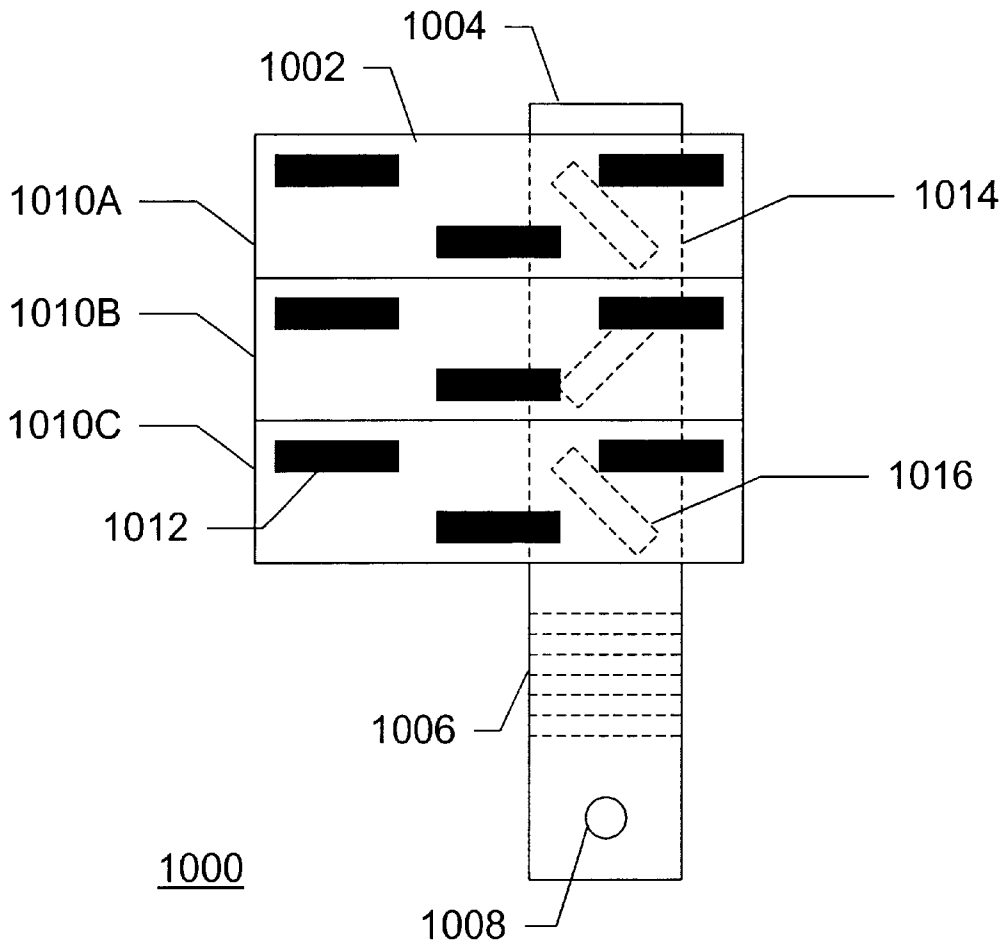
FIGS. 10, 11, and 12 are diagrams showing a number of exemplary antenna element assemblies.

An exemplary antenna element assembly 1000 is shown in FIG. 10. Assembly 1000 includes an antenna element 1002, waveguide portion 1004, waveguide filter 1006, and signal probe opening 1008. In this example, antenna element 1002 is a slotted receiving antenna element that is made up of three subantenna elements 101A, 1010B, and 1010C. Each sub-antenna element includes a plurality of receiving slots 1012. Waveguide portion 1004 includes antenna element feed structure 1014, which includes a plurality of antenna element feed slots 1016. Signal probe opening 1008 provides the capability to insert a signal probe to convert the electromagnetic wave signals to electrical signals.

The exemplary antenna element assembly shown in FIG. 10 is designed to provide global coverage in geosynchronous orbit. Preferably the size is approximately 2.1 wavelengths by 2.4 wavelengths, at the design frequency. For example, antenna element assembly 1000 may be used at a design frequency of approximately 30 GHz, which results in antenna element 1002 having dimensions of approximately 0.83 inches by 0.94 inches. Even though this element contains 9 slots, it is functionally a 1×1 element, as described above regarding FIG. 7*a*.

Figure 11:
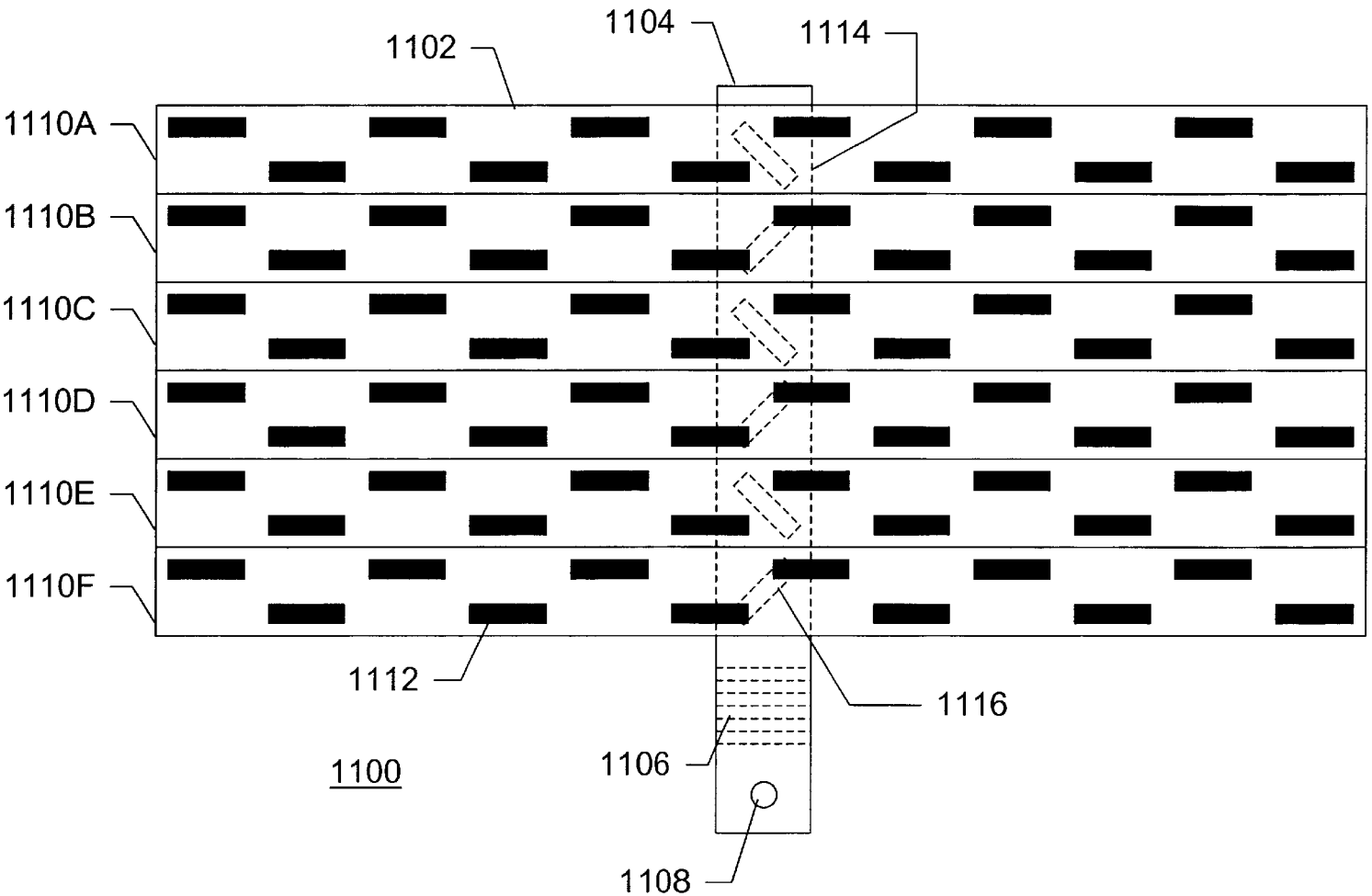

An exemplary antenna element assembly 1100 is shown in FIG. 11. Assembly 1100 includes an antenna element 1102, waveguide portion 1104, waveguide filter 1106, and signal probe opening 1108. In this example, antenna element 1102 is a slotted receiving antenna element that is made up of six sub-antenna antenna elements 1110A, 1110B, 1110C, 1110D, 1110E, and 1110F. Each sub-antenna element includes a plurality of receiving slots 1112. Waveguide portion 1104 includes antenna element feed structure 1114, which includes a plurality of antenna element feed slots 1116. Signal probe opening 1108 provides the capability to insert a signal probe to convert the electromagnetic wave signals to electrical signals.

The exemplary antenna element assembly shown in FIG. 11 is designed to provide coverage over a ±2°×±4° area (e.g., the continental United States (CONUS) from geosynchronous orbit). Even though this antenna has 72 slots, it is functionally a 4×2 element, as described above regarding FIG. 7*g*. Preferably the size is approximately 4.2 wavelengths by 9.6 wavelengths, at the design frequency. For example, antenna element assembly 1100 may be used at a design frequency of approximately 30 GHz, which results in antenna element 1102 having dimensions of approximately 1.65 inches by 3.78 inches. This antenna element configuration provides horizontal polarization. If the complete antenna array is rotated through 90° the coverage area will be ±4° by ±2° (instead of ±2° by ±4°) and vertical polarization will be provided.

Figure 12:
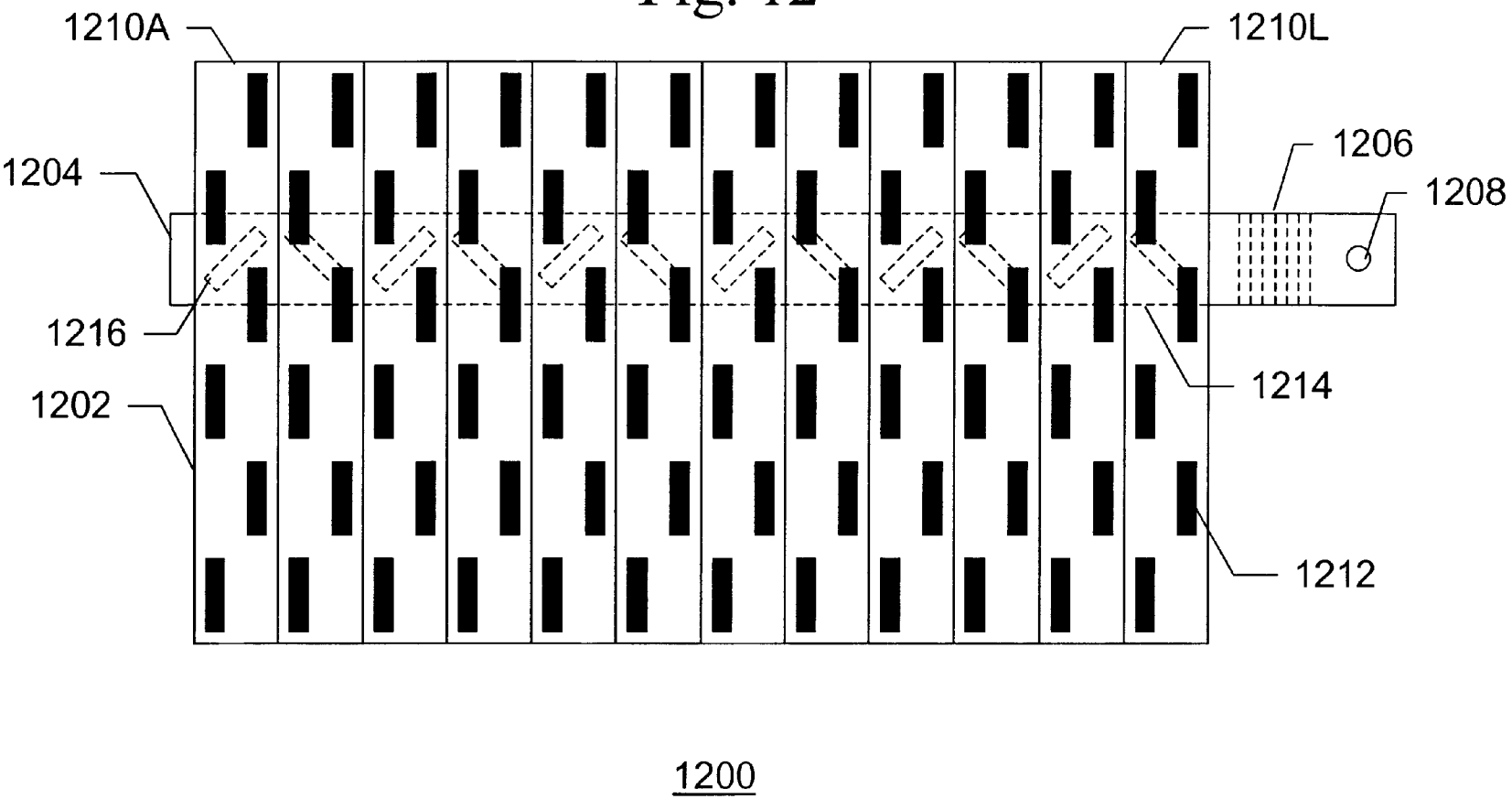

An exemplary antenna element assembly 1200 is shown in FIG. 12. The antenna element assembly includes an antenna element 1202, waveguide portion 1204, waveguide filter 1206, and signal probe opening 1208. In this example, antenna element 1202 is a slotted receiving antenna element that is made up of 12 sub-antenna elements 1210A–1210L. Each sub-antenna element includes a plurality of receiving slots 1212. Waveguide portion 1204 includes antenna element feed structure 1214, which includes a plurality of antenna element feed slots 1216. Signal probe opening 1208 provides the capability to insert a signal probe to convert the electromagnetic wave signals to electrical signals.

The exemplary antenna element assembly shown in FIG. 12 is designed to provide coverage over a ±2°×±4° area (e.g., the continental United States (CONUS) from geosynchronous orbit). Preferably the size of each antenna element sub-assembly is approximately 4.2 wavelengths by 9.6 wavelengths, at the design frequency. For example, antenna element assembly 1200 may be used at a design frequency of approximately 30 GHz, which results in antenna element 1202 having dimensions of approximately 1.65 inches by 3.78 inches. This antenna element configuration provides vertical polarization. If the complete antenna array is rotated through 90° the coverage area will be ±4°×±2° (instead of ±2°×±4°) and horizontal polarization will be provided.

Figure 13:
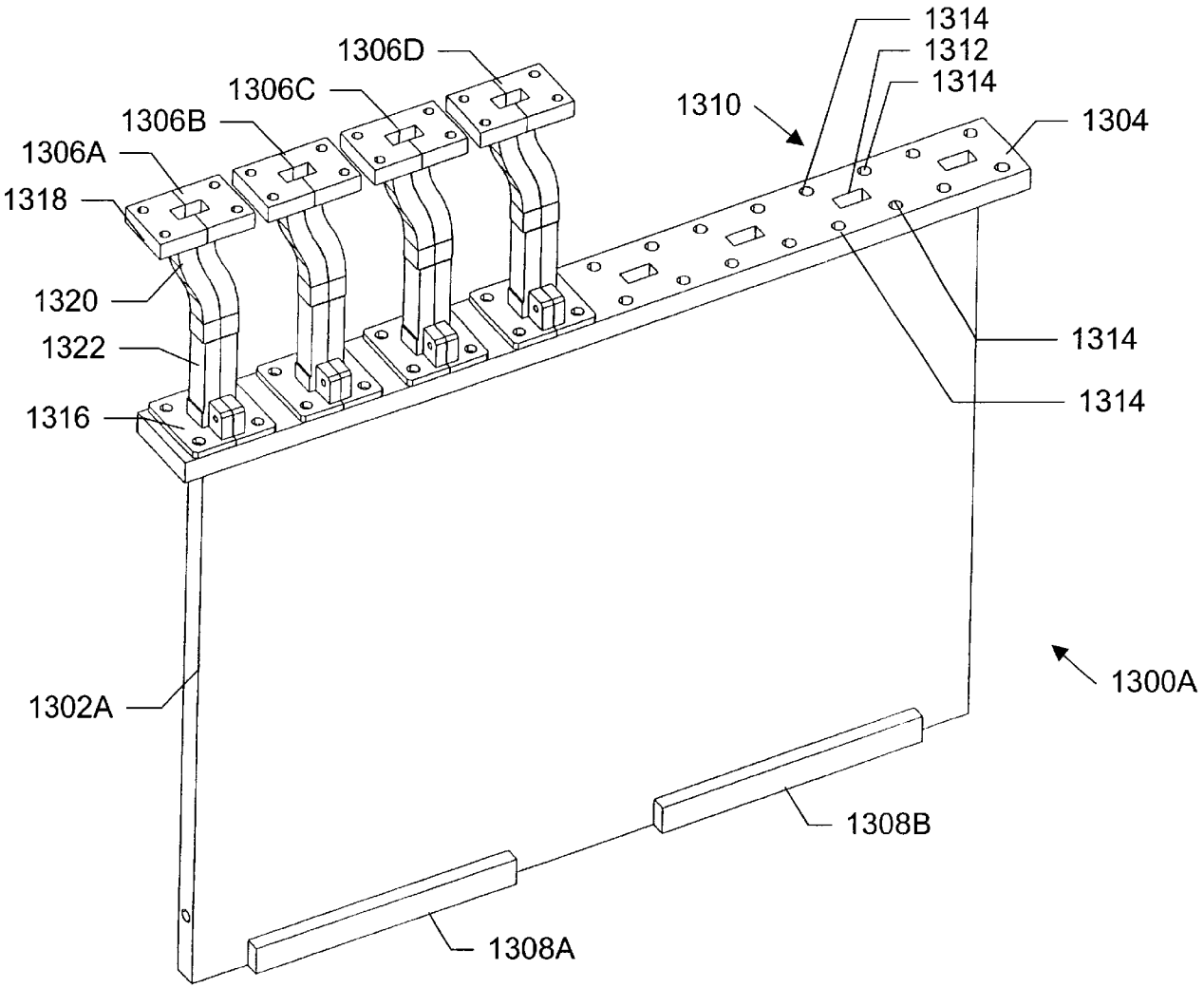
FIG. 13 shows a partially built-out circuit board assembly, which is included in the present invention

As can be seen from FIG. 1, the present invention includes a number of similar elements, which are similarly connected. An important aspect of the present invention is the repetitive and modular packaging and connection of these similar elements. A modular building block, according to the present invention, as well as constituent portions of the building block, are shown in FIGS. 13–20. A partially built-out circuit board assembly 1300A, which is included in the present invention, is shown in FIG. 13. Circuit board assembly 1300A includes circuit board 1302A, mounting plate 1304, and a plurality of waveguide assemblies 1306A–1306D. Circuit board assembly 1302A contains substantially all of the circuitry shown in FIG. 2, which illustrates an amplifier/BFMM board. Circuit board 1302A includes connectors 1308A and 1308B, which provide electrical power and radio frequency (RF)/control signal connection of circuit board 1302A with the remainder of the antenna system.

Mounting plate 1304 is attached to circuit board 1302A and provides a means of mounting waveguide assemblies, such as assemblies 1306A–1306D, to circuit board 1302A. Mounting plate 1304 includes a plurality of waveguide mounting positions, such as waveguide mounting position 1310, for mounting waveguide assemblies. In FIG. 13, four waveguide assemblies are shown, but mounting plate 1304 is shown as having eight waveguide mounting positions. A key feature of the present invention is the capability to populate all, or only a portion, of the available mounting positions. Each waveguide mounting position 1310 includes a waveguide channel 1312 (also shown in FIG. 6 as item 612) and a plurality of mounting holes 1314. Waveguide channel 1312 provides a continuation of the waveguide cavity for the attached waveguide, so as to transmit the radio frequency signal to the signal probe. Mounting holes 1314 allow mounting of the waveguide assemblies to mounting plate 1304.

Each waveguide assembly, such as waveguide assembly 1306A, includes a first mounting bracket 1316, a second mounting bracket 1318, a waveguide portion 1320 (also shown on FIG. 6 as item 604), and a waveguide filter 1322 (also shown in FIG. 6 as item 606). The first mounting bracket 1316 provides the capability to mount the waveguide assembly on mounting bracket 1304. The second mounting bracket 1318, which is located at the other end of waveguide assembly 1306A from the first mounting bracket 1316, provides the capability to mount an antenna element to waveguide assembly 1306A. Waveguide portion 1320 is provided to allow the antenna element to be placed in the desired physical location relative to circuit board 1302A. Typically, waveguide portion 1320 includes one or more bends or jogs, which provide the proper positioning of the antenna element. Waveguide filter 1322 provides bandpass filtering to attenuate spurious and other unwanted signals that are not in the frequency band being used for communications.

Figure 14:
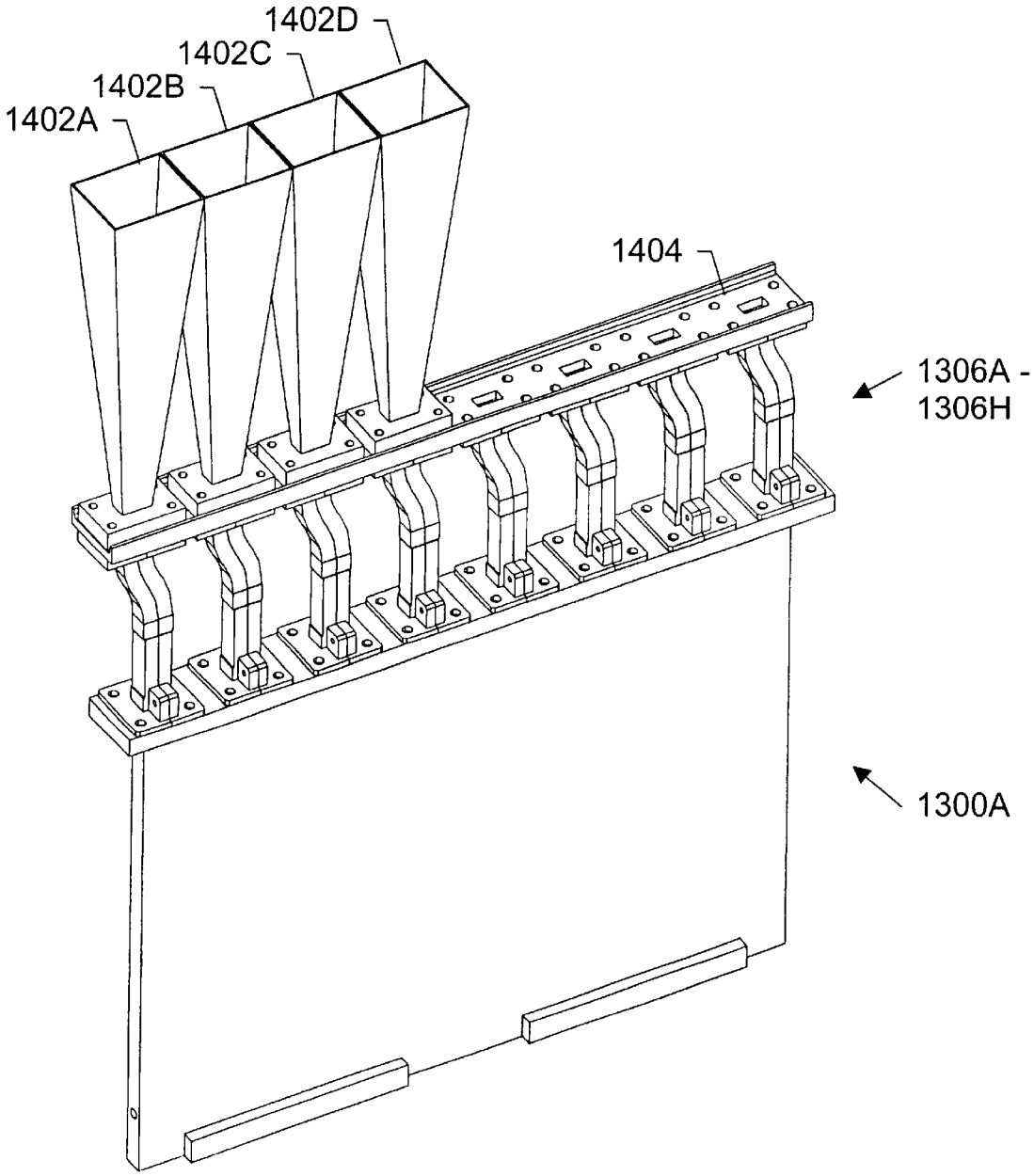
FIG. 14 shows the circuit board assembly shown in FIG. 13, along with additional installed components.

The circuit board assembly shown in FIG. 13, along with additional installed components, is shown in FIG. 14. In FIG. 14, all eight mounting positions are shown as being populated with waveguide assemblies 1306A–1306H. In addition, antenna elements 1402A–1402D (also. shown in FIG. 6 as 602) are shown mounted on waveguide assemblies 1306A–1306H. Mounting bracket 1404 is attached between the antenna elements and the waveguide assemblies to structurally couple to each other the ends of the waveguide assemblies to which the antenna elements are attached. Mounting bracket 1404 provides structural rigidity to the waveguide assemblies. The antenna elements shown in FIG. 14, such as antenna element 1402A, are horn antennas. Horn antenna elements are shown as an example only, the present invention contemplates other antenna element structures, such as slotted antenna elements.

Figure 15:
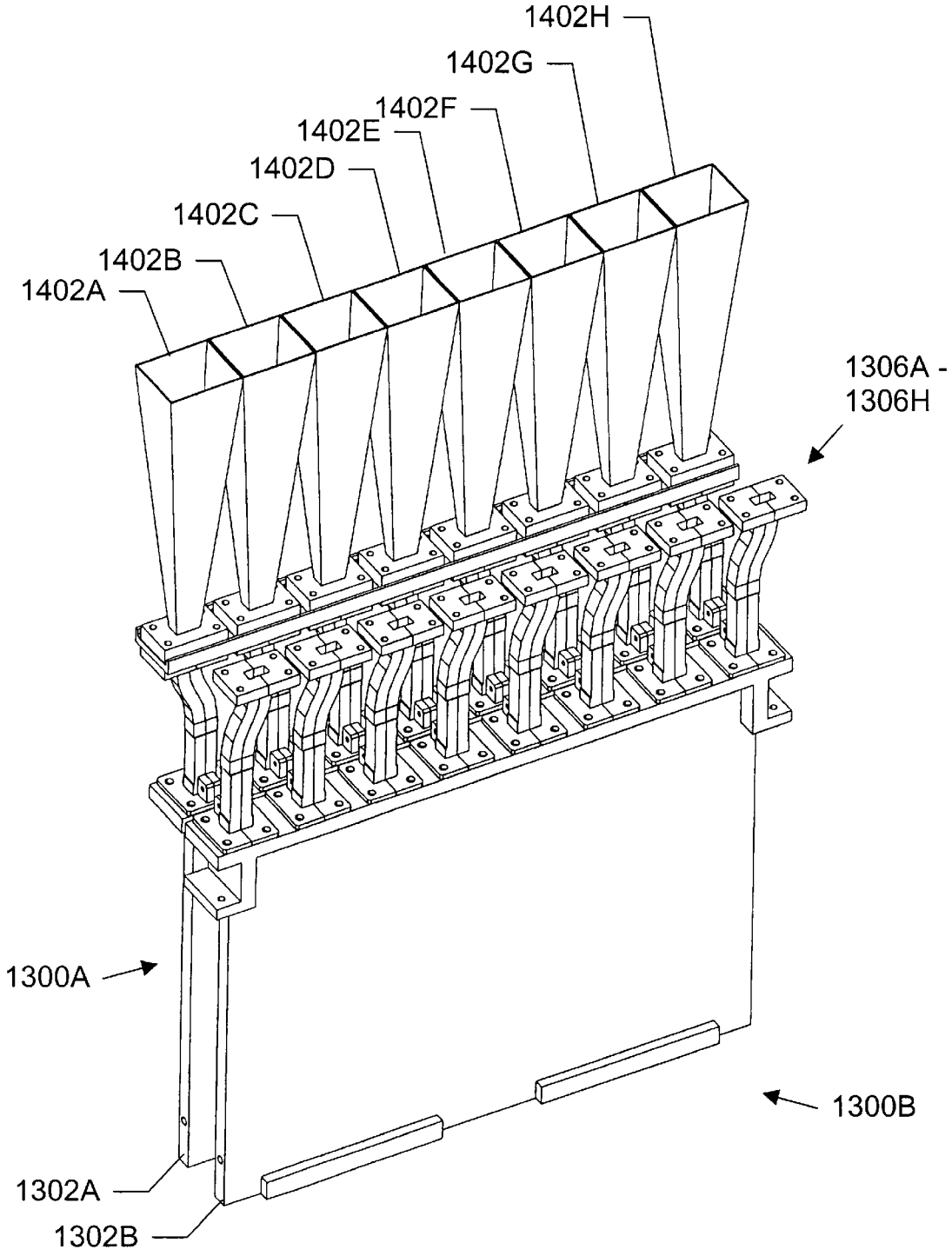
FIG. 15 shows two circuit board assemblies, each similar to the circuit board assembly shown in FIG. 14.

Two circuit board assemblies, each similar to the circuit board assembly shown in FIG. 14, are shown in FIG. 15. In FIG. 15, two circuit board assemblies 1300A and 1300B are shown positioned next to each other. Circuit board assembly 1300A is shown fully built out and assembled. Circuit board assembly is shown with all waveguide mounting positions occupied by antenna element assemblies 1402A–1402H. As described, each antenna element assembly incorporates a waveguide assembly, which typically includes one or more bends or jogs to provide the proper positioning of the antenna element. In one embodiment, waveguide assemblies attached to adjacent circuit board assemblies have bends or jogs that are opposite to each other, which allows placement of the antenna elements on a triangular grid. For example, as shown in FIG. 14, antenna element assemblies 1402A–1402H, which are attached to circuit board assembly 1300A, include bends or jogs to the left, while waveguide assemblies 1306A 1306H, which are attached to adjacent circuit board assembly 1300B, include bends or jogs to the right. Thus, antenna elements that are attached to adjacent circuit board assemblies may be placed on a triangular grid. The placement of antenna elements on a triangular grid may be seen more clearly by reference, for example, to FIG. 15. The waveguide mounting positions 1310 (FIG. 13) may be arranged on a square grid to ease manufacturing and assembly.

Figure 16:
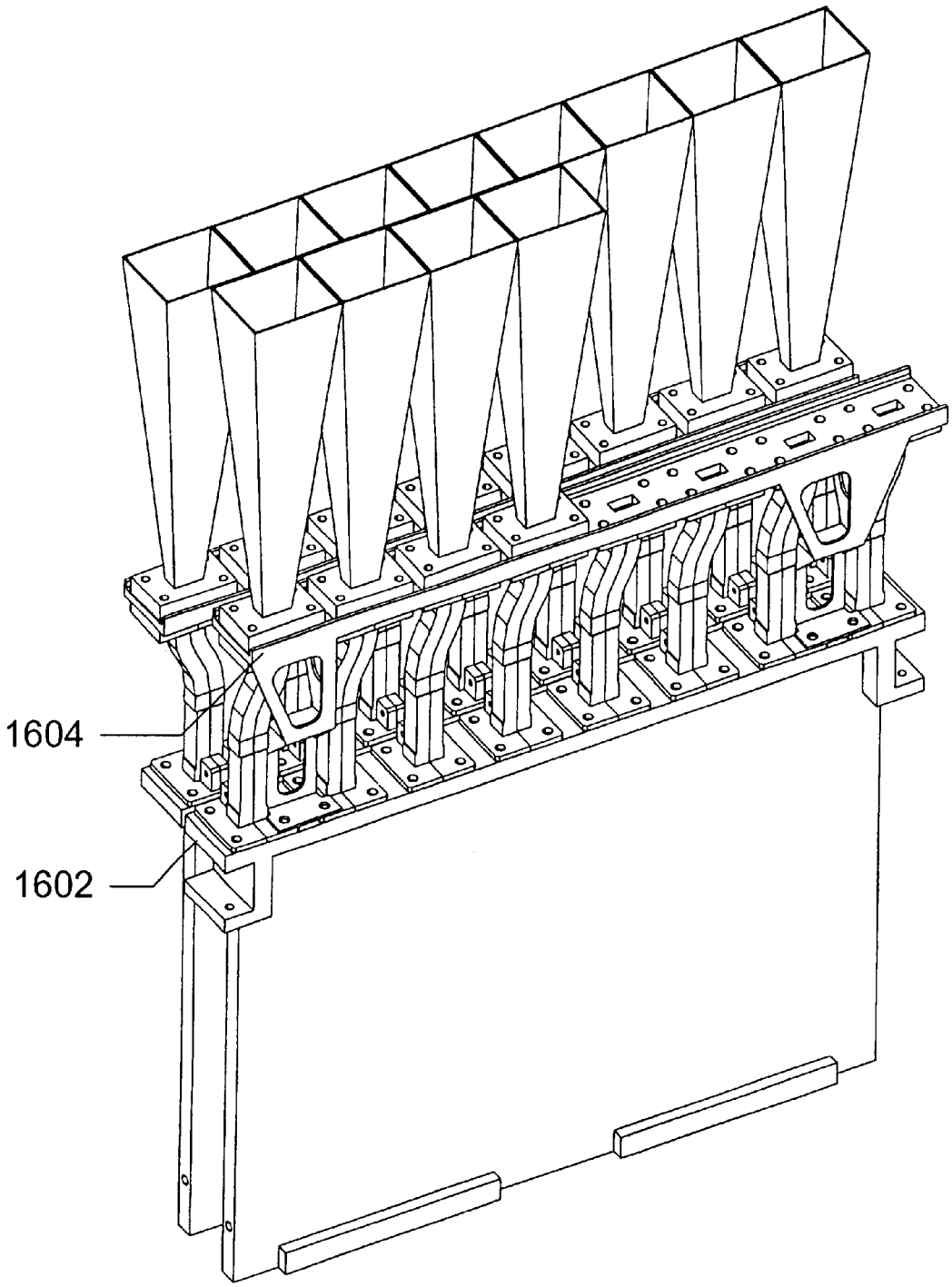
FIG. 16 shows the circuit board assemblies shown in FIG. 15, along with additional components.

The circuit board assemblies shown in FIG. 15 are also shown in FIG. 16. In FIG. 16, mounting bracket 1604 is shown attached to mounting plate 1602. Mounting bracket 1604 provides structural rigidity to the antenna element assemblies.

Figure 17:
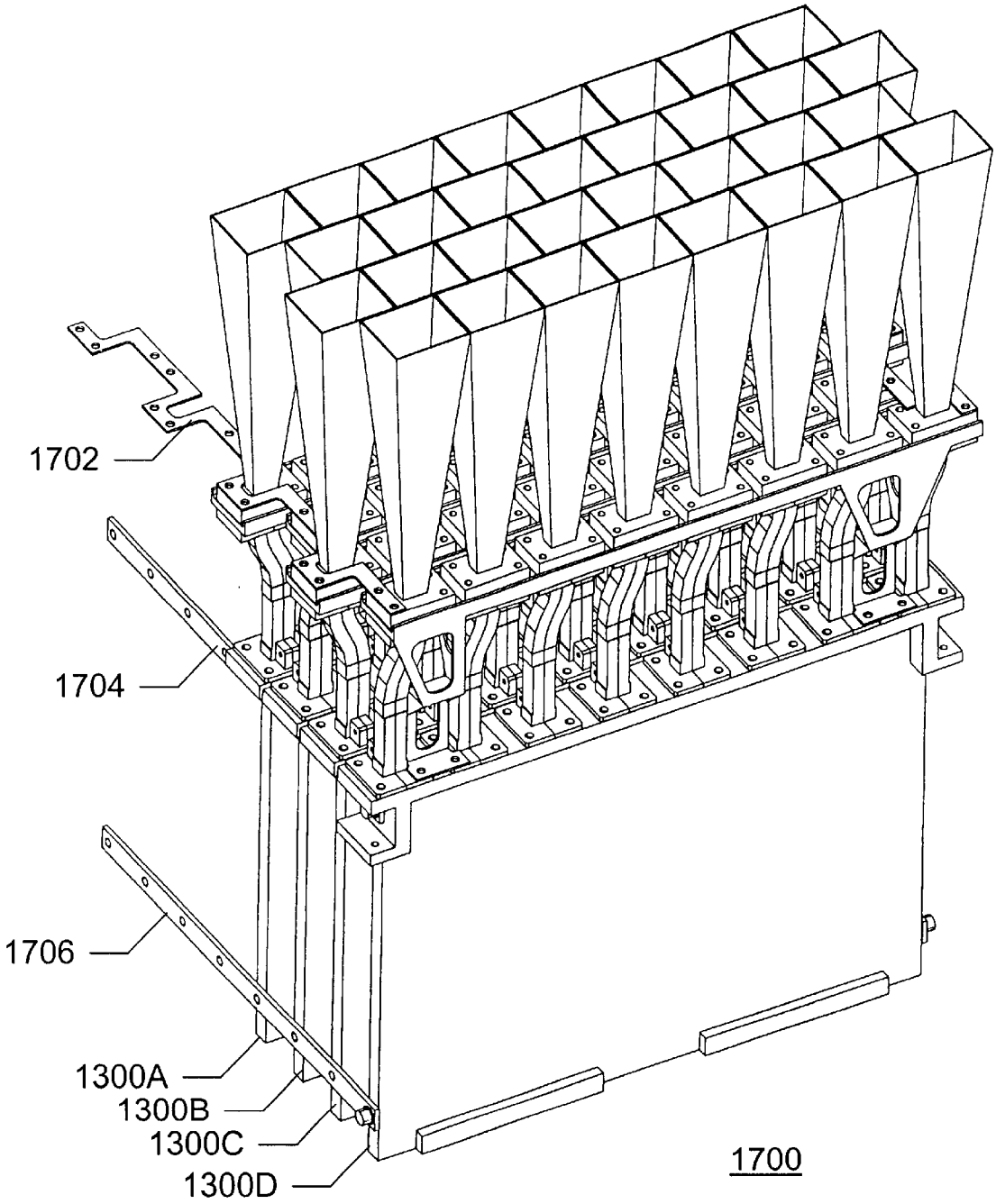
FIG. 17 shows a partially built-out antenna array module, according to the present invention.

An antenna array module 1700 is shown in FIG. 17. In FIG. 17, module 1700 is shown partially built-out with four fully populated circuit board assemblies 1300A, 1300B, 1300C, and 1300D. Module brackets 1702, 1704 and 1706 have been attached to the circuit board assemblies to provide additional structural integrity to module 1700.

Figure 18:
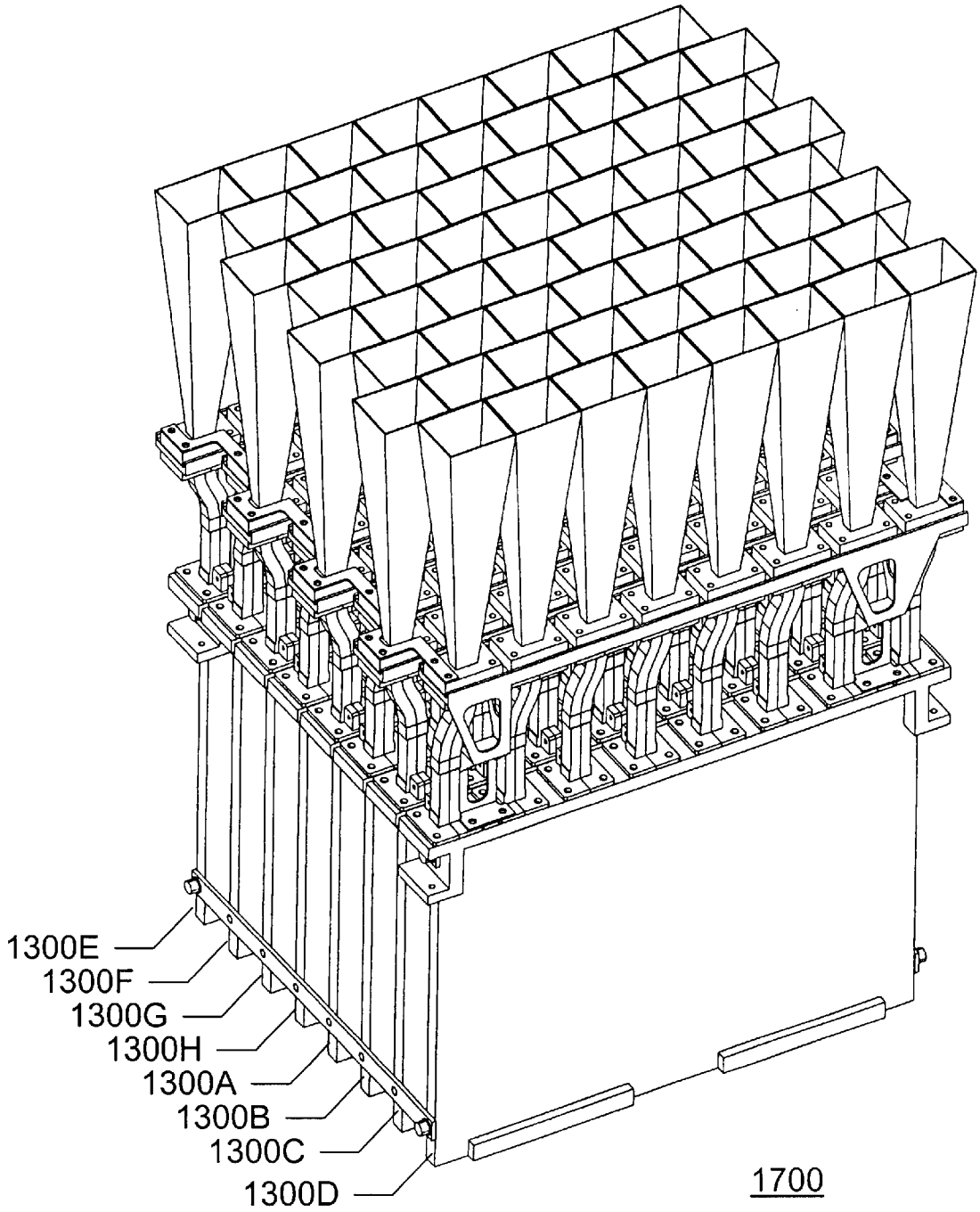
FIG. 18 shows an antenna array module shown in FIG. 17, populated with all circuit board assemblies, waveguide assemblies, and antenna elements.

Antenna array module 1700, shown in FIG. 17, is also shown in FIG. 18. In FIG. 18, module 1700 is shown with eight fully populated circuit board assemblies 1300A, 1300B, 1300C, 1300D, 1300E, 1300F, 1300G, and 1300H.

Figure 19:
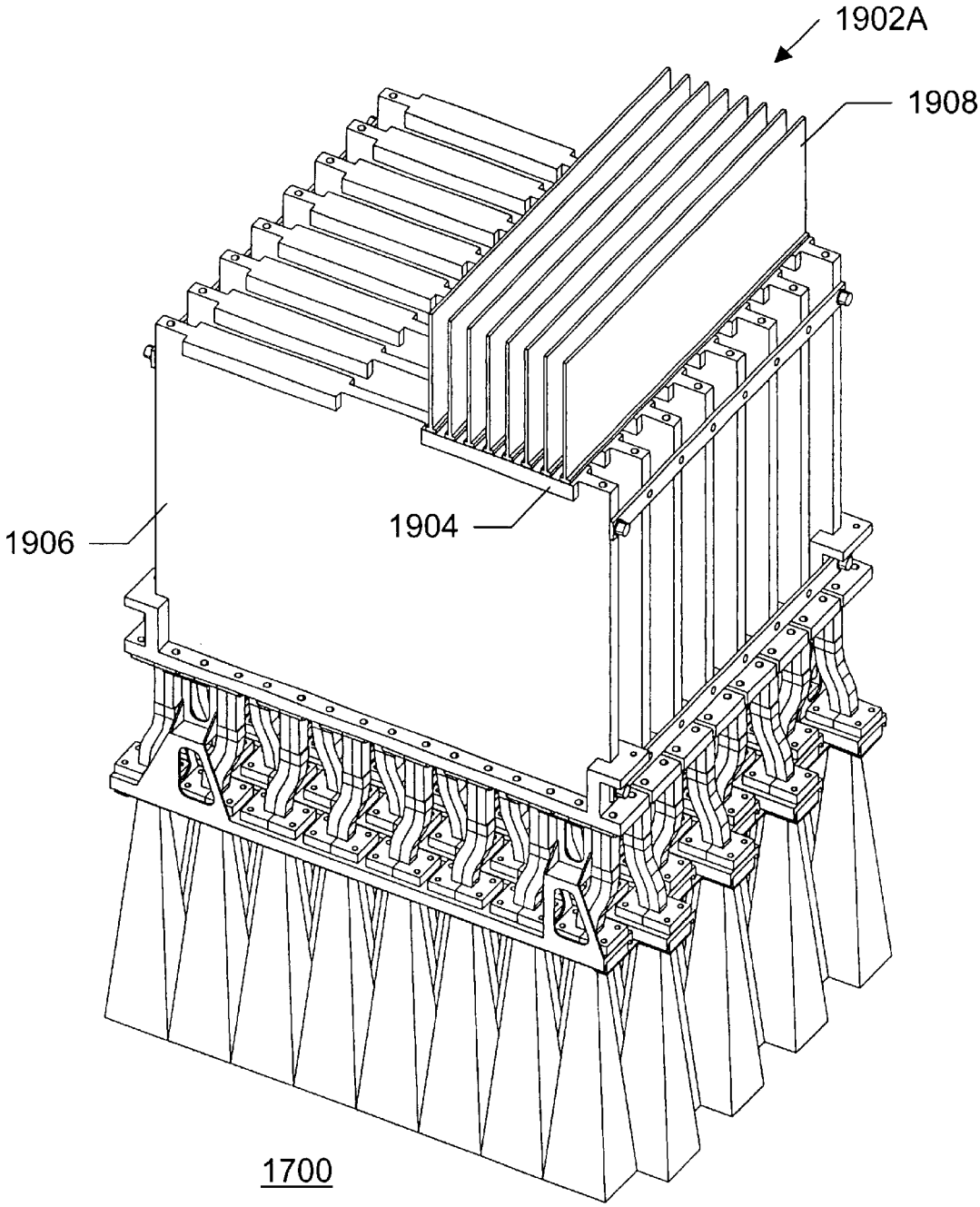
FIG. 19 shows a rear view of the antenna array module shown in FIG. 18 with some additional components.

A rear view of antenna array module 1700, shown in FIG. 18, is shown in FIG. 19. In FIG. 19, module 1700 includes backplane assembly 1902A, which is connected to connectors on each circuit board in module 1700. For example, connector 1904 of circuit board 1906 is connected to backplane assembly 1902A. Typically, backplane assembly 1902A includes a plurality of backplane circuit boards, such as backplane circuit board 1908. Backplane assembly 1902A would contain, for example, for the configuration shown in FIG. 3, power combiners 306A-A to 306A-M. Backplane circuit board 1908 may contain, for example, two such power combiners.

Figure 20:
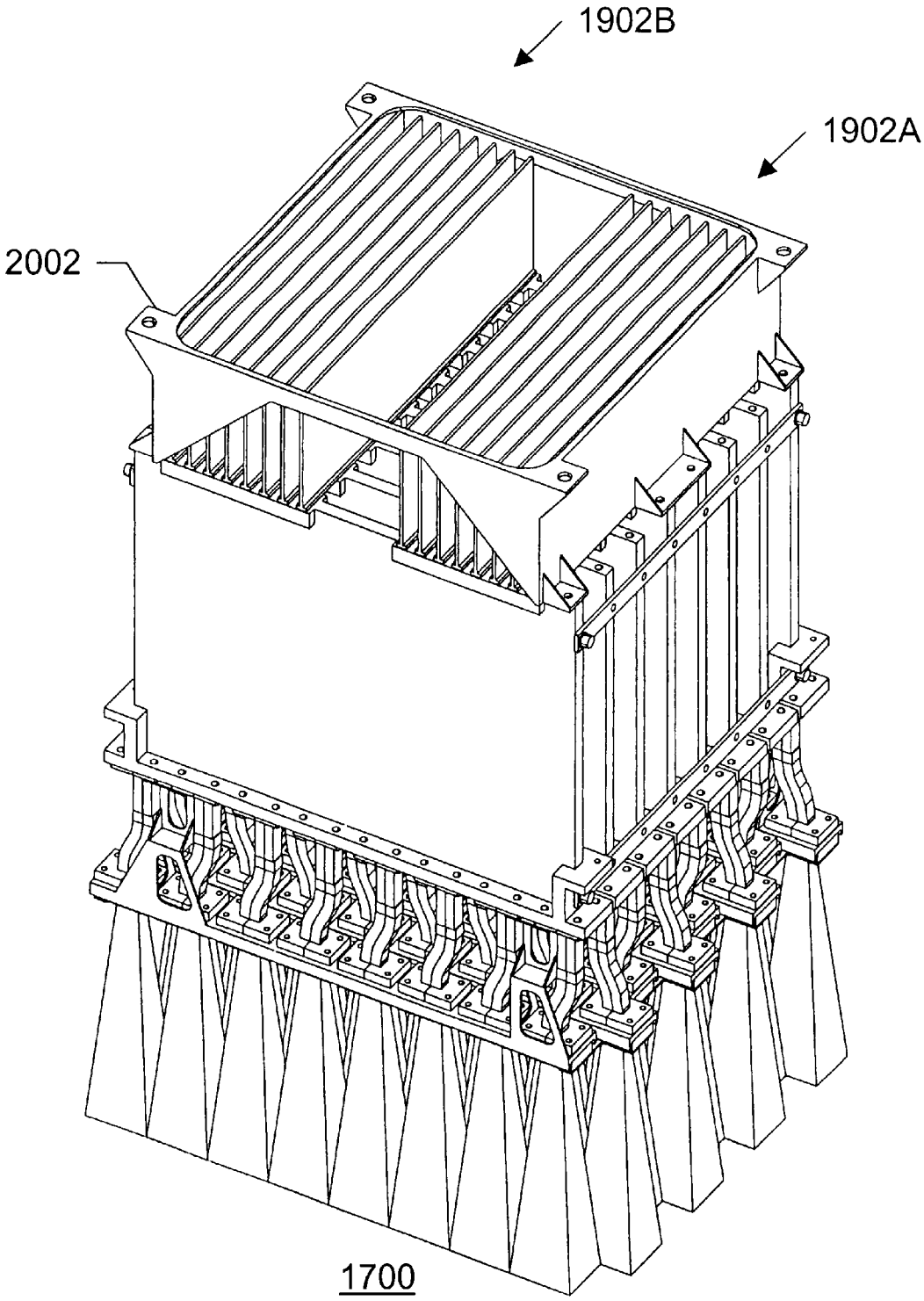
FIG. 20 shows a rear view of the antenna array module shown in FIG. 19, along with additional components.

A rear view of antenna array module 1700, shown in FIG. 19, is also shown in FIG. 20. In FIG. 20, module 1700 includes two backplane assemblies 1902A and 1902B, which are connected to connectors on each circuit board in module 1700. In addition, module 1700 is shown including backplane bracket 2002, which fastens backplane assemblies 1902A and 1902B to the circuit boards in module 1700. Backplane bracket 2002 provides additional structural integrity for module 1700. For simplicity, the beam connectors, the antenna array module DC/DC converter and control interface assemblies are not shown.

Figure 21:
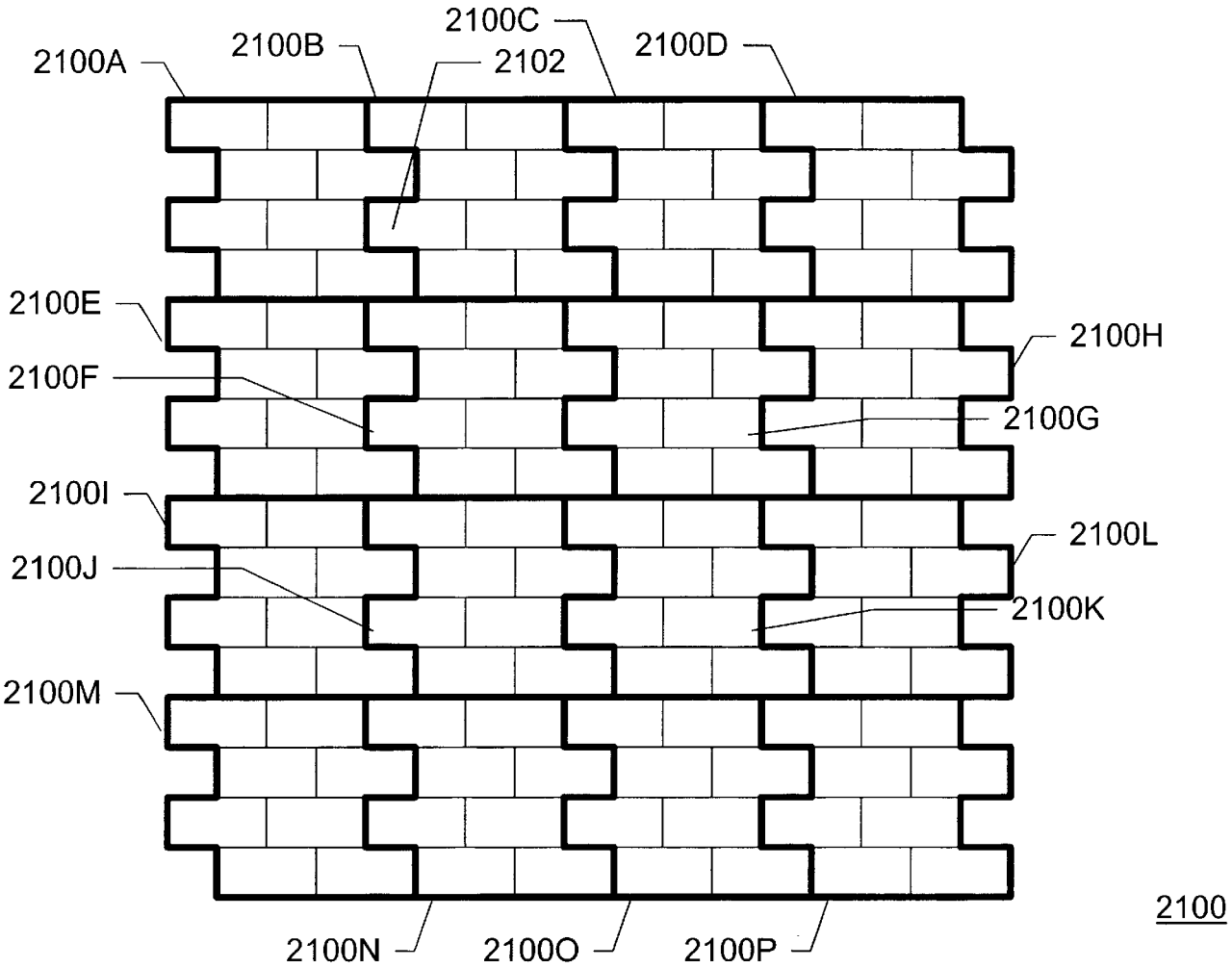
FIG. 21 is a front view of a complete antenna array, according to the present invention.

An example of a complete antenna array 2100, which includes sixteen antenna array modules 2100A–2100P, is shown in FIG. 21. The sensitivity of the receive array to collect incoming signals is proportional to the number of array modules used. The array modules have been designed so that any number of them may be combined. In this way, the design goal of modularity with respect to receive sensitivity has be achieved. Antenna array modules 2100A–P interlock, to form a contiguous antenna array structure. The modules used have overlapping of antenna elements and circuit board assemblies within each module, but also between two modules. Thus, adjacent modules overlap. For example, module 2100B overlaps module 2100A. In particular, antenna element 2102 overlaps a circuit board included in module 2100B. Although this overlapping does present manufacturing and assembly challenges, it is required to achieve good antenna performance and provides good packing density of antenna elements and modules. Conventional radio frequency (RF), control, and DC power harnesses are used to electrically connect the antenna array modules to form the complete antenna array.

Preferably, for a given embodiment, all circuit boards are of similar design. For example, all circuit boards may be designed to accommodate the circuitry (LNAs and beamformers) needed to handle eight antenna elements and 32 beams. A feature of the present invention is that these similar circuit boards may be fully populated or partially populated. In this example, a fully populated circuit board would have mounted on it the circuitry needed to handle eight antenna elements and 32 beams. A partially populated circuit board would have mounted on it the circuitry needed to handle only four or two antenna elements, with 16 or 32 beams, or eight antenna element with 16 beams. The board itself includes the interconnections needed to accommodate eight antenna elements and 32 beams. Thus, the present invention can accommodate antenna arrays having varying numbers of antenna elements and beams without requiring redesign of the circuit boards, or the modules mounted to the board, for each embodiment. This means that the present invention can support applications with very different coverage/scan and beam quantity requirements by using standard building blocks. This reduces the cost/risk and time required to fabricate an antenna array for an application with a different coverage/scan and beam quantity requirement.

Figure 22:
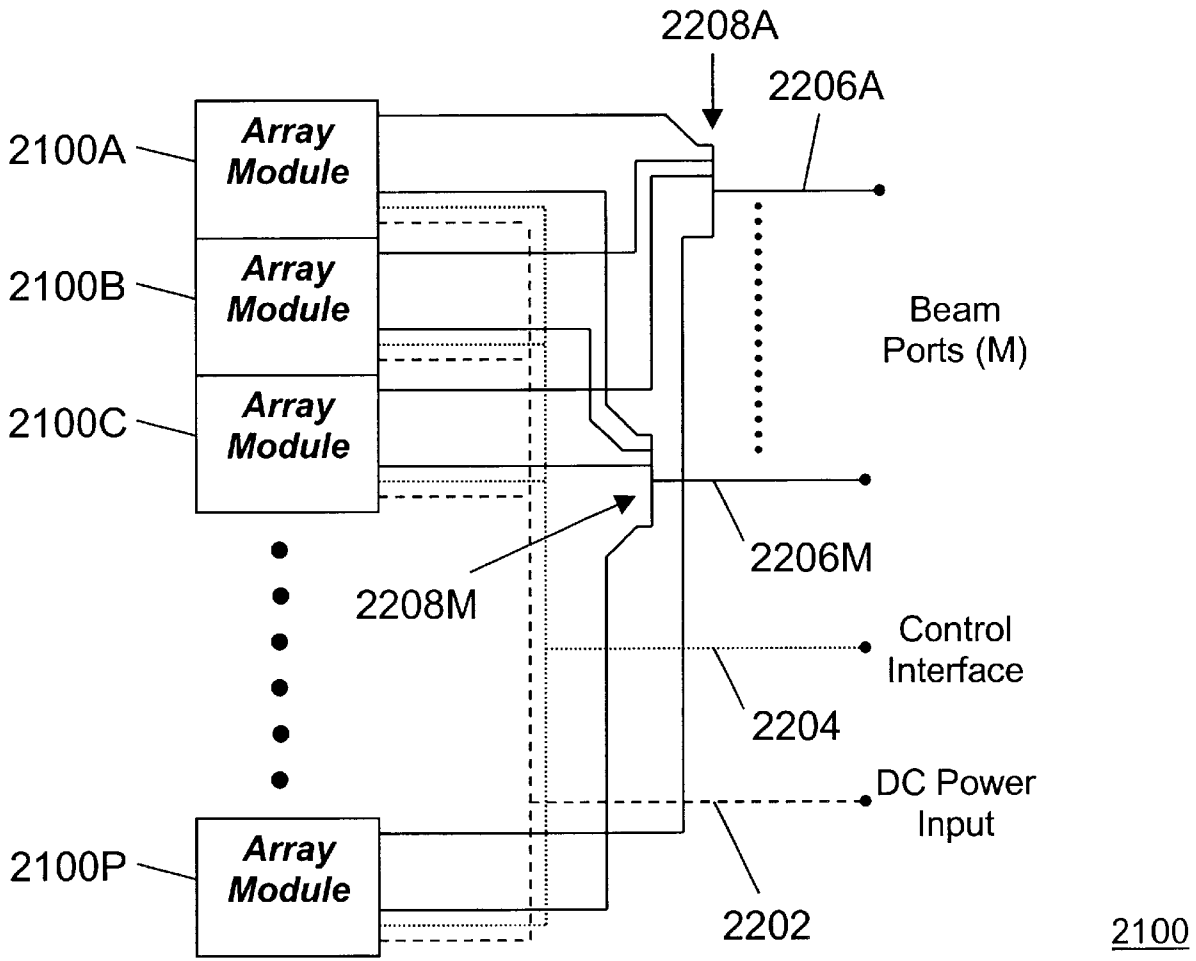
FIG. 22 is an exemplary block diagram of electrical connections between the antenna array modules that are contained in a complete antenna array.

FIG. 22 shows the electrical connections between the antenna array modules 2100A–P that are contained within the complete antenna array 2100. As shown in FIG. 5, each antenna array module has M (where M is 32 in a preferred embodiment) beam outputs. These beam outputs are connected with M RF harnesses 2206A–M. Each RF harness contains a P:1 way power combiner 2208A–M to combine the signals from the array modules. Each power combiner is connected to one of the array beam ports. Control signals are distributed to/from the antenna array modules using control harness 2204. DC power is distributed to the antenna array modules using DC power harness 2202.

Figure 23:
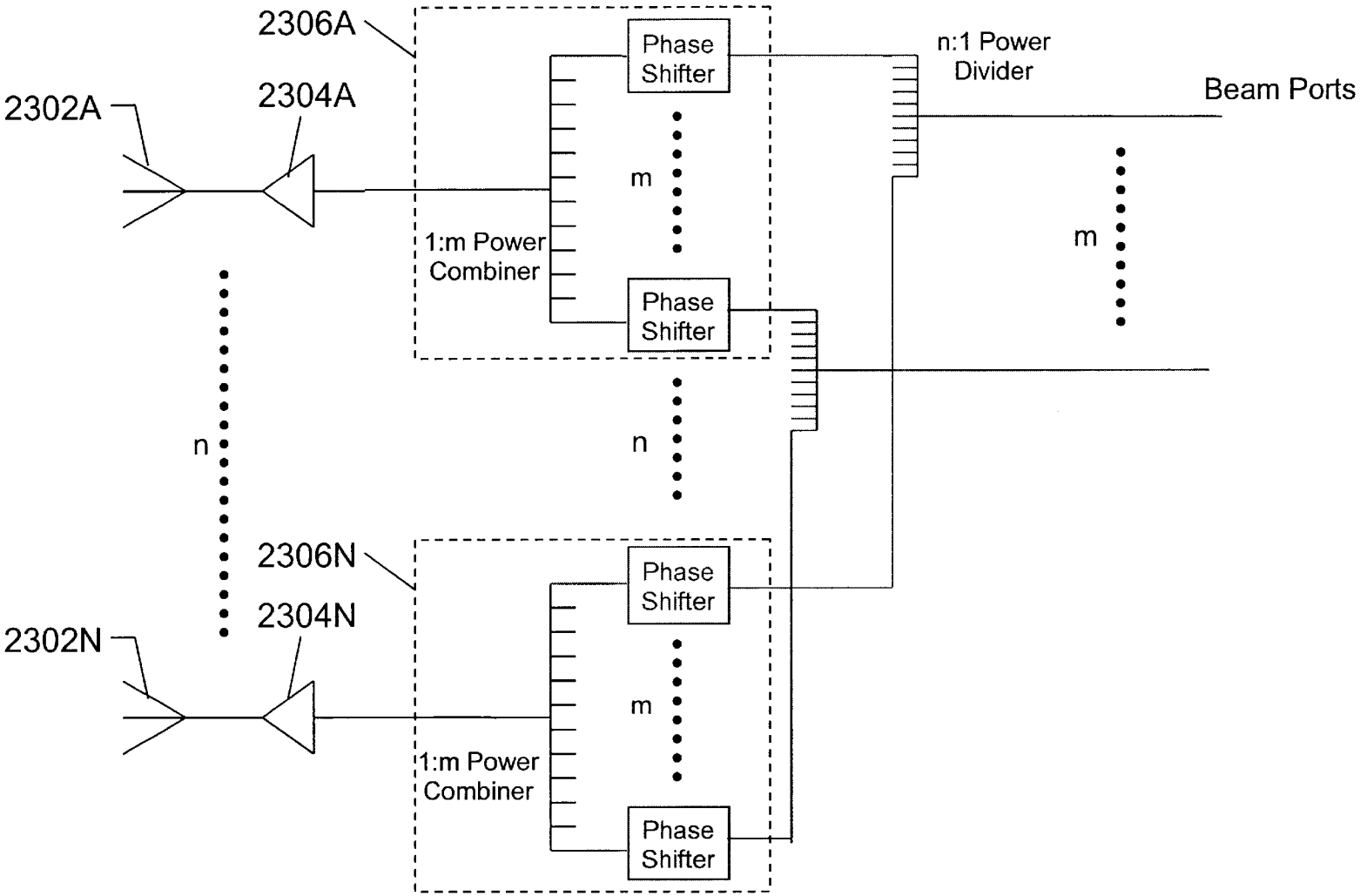
FIG. 23 is a schematic diagram of a circuit of a phased array transmitting system, according to the present invention.

FIG. 23 shows a transmit embodiment of the present invention. It can be seen that FIG. 23 is very similar to FIG. 1. However the low noise amplifiers 104A–104N in FIG. 1 are replaced by power amplifiers 2304A–2304N in FIG. 23. Each output of a beamformer 2306A–2306N is connected to the input to a power amplifier. Each output of a power amplifier is connected to the input to a radiating element assembly 2302A–2302N.

Figure 24:
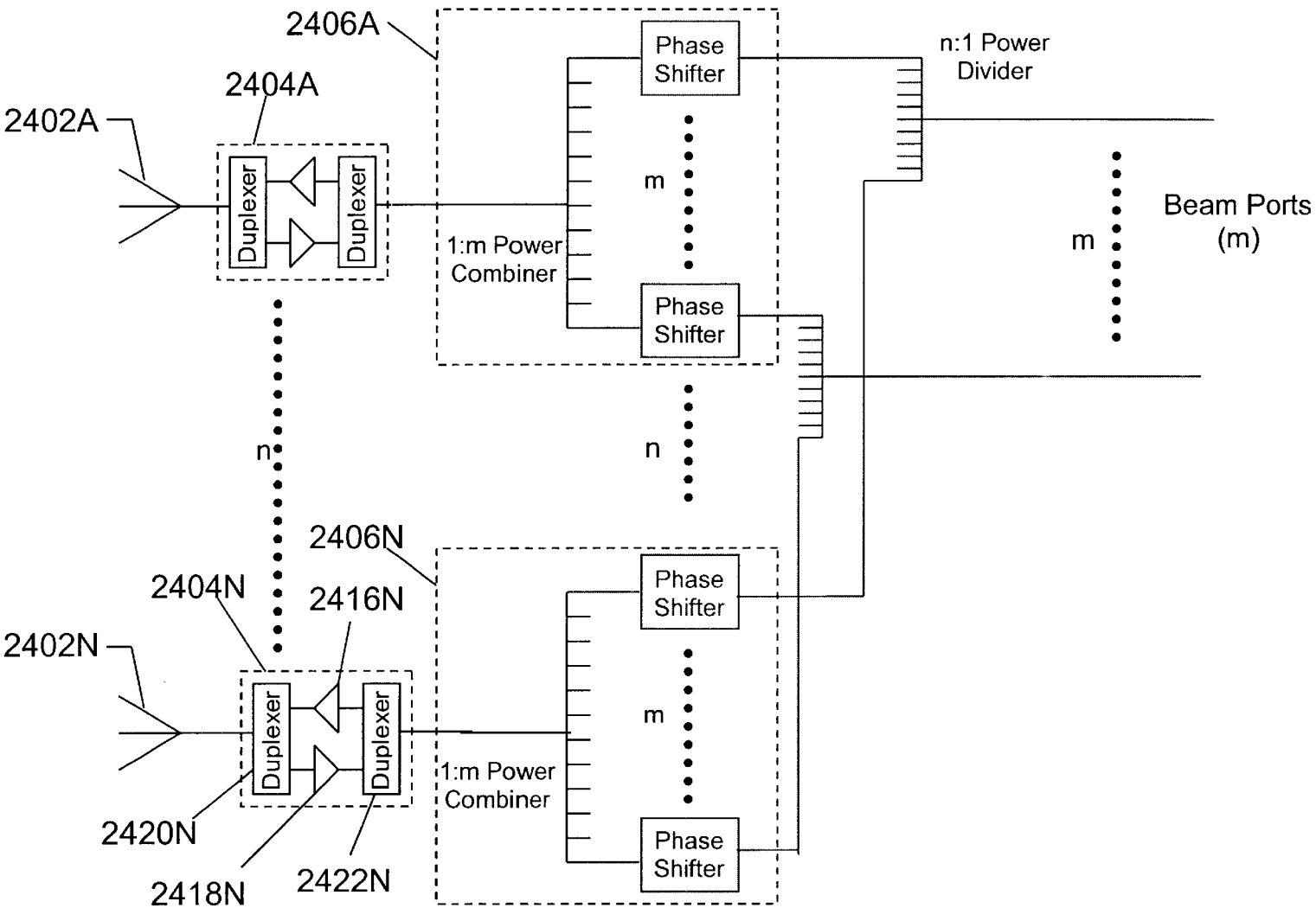
FIG. 24 is a schematic diagram of a circuit of a phased array transmit/receive system, according to the present invention.

FIG. 24 shows a transmit/receive embodiment of the present invention. This implementation is of interest for radar and half duplex communications applications. It can be seen that FIG. 24 is very similar to FIG. 1. However the Low Noise Amplifiers (LNAs) 104A–104N in FIG. 1 are replaced by duplexed amplifier pairs 2404A–2404N in FIG. 24. Each duplexed amplifier pair consists of a power amplifier 2416N and an LNA 2418N connected between a pair of duplexers 2420N and 2422N. In transmit operation the signal emanating from a beamformer 2406N is connected by duplexer 2422N to the input of the power amplifier 2416N. The output of this power amplifier is connected by duplexer 2420N to the input of radiating element assembly 2402N. In receive operation the signal emanating from radiating element assembly 2402N is connected by duplexer 2420N to the input of LNA 2418N. The output of this LNA is connected by duplexer 2422N to the input of beamformer 2406N. The duplexers may be implemented as switches or circulators.

Although specific embodiments of the present invention have been described, it will be understood by those of skill in the art that the present invention contemplates other embodiments as well. For example, in some applications it may be desired to provide an amplitude taper across the antenna aperture to reduce sidelobe levels (as is well understood by those of.skill in the art). In this case, a phase shifter/attenuator may be used-instead of a phase shifter (114A, 114M in FIG. 1). Also in some applications it may be desired to implement the phased array antenna using intermediate frequency (IF) beamforming. In this case up/down converter circuits and local oscillator distribution circuits must be added. The architecture used to interconnect these additional components is well known to those of skill in the art. Circular polarization may also be achieved by adding an external polarizer or by using circularly polarized antenna elements.

In addition, one of skill in the art would recognize that there are other embodiments that are equivalent to the described embodiments. For example, different quantities of components and/or elements could be used in any subassembly, or different radiating elements and/or filter types could be used. Accordingly, it is to be understood that the invention is not to be limited by the specific illustrated embodiments, but only by the scope of the appended claims.

What is claimed is:

1. A configurable modular array building block for an antenna array comprising:

a plurality of antenna elements, each antenna element operable to receive and output an electromagnetic wave signal, the antenna elements arranged adjacent to each other;

a plurality of antenna element interfaces, each antenna element interface coupled to one of the plurality of antenna elements; and one or more circuit board assemblies, the one or more circuit board assemblies arranged substantially parallel to each other, each circuit board assembly having a plurality of antenna elements connected thereto, each antenna element connected to the circuit board assembly by an antenna element interface, each circuit board assembly comprising:

a plurality of amplifiers, each amplifier operable to amplify a received signal from an antenna element, each amplifier receiving a signal from an antenna element via an antenna element interface; and one or more beamformers, each beamformer coupled to an output of an amplifier;

wherein the one or more circuit board assemblies, the plurality of antenna element interfaces and the plurality of antenna elements are arranged so as to form a module, and wherein the module can be configured with different scan coverages by altering one or more of the number of antenna elements, the number of circuit boards, a dimension of the antenna elements, or the number of beamformers on each circuit board assembly.

2. The module of claim 1, wherein the antenna elements are arranged adjacent to each other so as to form a grid pattern.

3. The module of claim 2, wherein the antenna elements are arranged adjacent to each other so as to form a triangular grid pattern.

4. The module of claim 2, wherein the antenna elements are arranged adjacent to each other so as to form a rectangular grid pattern.

5. The module as recited in claim 1, wherein the antenna elements comprises an antenna element selected from the group consisting of a 1×1 antenna elements, a 2×1 antenna element, a 1×2 antenna element, a 2×2 antenna element, a 4×1 antenna element, a 1×4 antenna element, a 4×2 antenna element, a 2×4 antenna element, and a 4×4 antenna element.

6. The module of claim 1, wherein the antenna elements are arranged so as to form a plurality of rows and the antenna elements and antenna element interfaces are oriented oppositely in adjacent rows.

7. The module of claim 6, wherein the circuit boards have non-uniform spacing within the module.

8. The module of claim 7, wherein the antenna element interfaces comprise waveguide assemblies.

9. The module of claim 1, wherein the antenna elements are arranged so as to form a plurality of rows and the antenna elements and antenna element interfaces are oriented similarly in adjacent rows.

10. The module of claim 9, wherein the circuit boards have uniform spacing within the module.

11. The module of claim 10, wherein the antenna element interfaces comprise waveguide assemblies.

12. The module of claim 1, wherein each antenna element interface comprises a waveguide assembly.

13. The module of claim 12, wherein each waveguide assembly further comprises a waveguide filter.

14. The module of claim 12, wherein each waveguide assembly further comprises a signal probe operable to convert an electromagnetic wave signal from the antenna to a corresponding electrical signal and output the electrical signal to the amplifier.

15. The module of claim 1, comprising larger antenna elements and a correspondingly smaller number of circuit board assemblies.

16. The module of claim 1, comprising larger antenna elements and correspondingly less populated circuit board assemblies.

17. The module of claim 1, comprising larger antenna elements and a correspondingly smaller number of less populated circuit board assemblies.

18. The module of claim 1, comprising smaller antenna elements and a correspondingly larger number of circuit board assemblies.

19. The module of claim 1, comprising smaller antenna elements and correspondingly more populated circuit board assemblies.

20. The module of claim 1, comprising smaller antenna elements and a correspondingly larger number of more populated circuit board assemblies.

21. The module of claim 1, wherein the beamformers are radio frequency beamformers.

22. The module of claim 1, wherein the beamformers are intermediate frequency beamformers.

23. The module of claim 1, wherein connections between the plurality of amplifiers and the plurality of beamformers are interleaved so that if a number of amplifiers are omitted from a circuit board assembly, at least one beamformer can be omitted from the circuit board assembly.

24. The module as recited in claim 1, wherein the one or more beamformers comprise a power divider and a plurality of phase shifters, the power divider configured to receive a signal from an amplifier and divide the signal into a plurality of signals that are coupled to the plurality of phase shifters.

25. The module as recited in claim 24, wherein the one or more beamformers comprises 16 or 32 phase shifters, and the power divider is configured to divide the received signal into 16 or 32 signals.

26. The module as recited in claim 24, wherein the one or more beamformers further comprise a plurality of attenuators.

27. The module as recited in claim 26, wherein the one or more beamformers comprise 16 or 32 phase shifters and attenuators, and the power divider is configured to divide the received signal into 16 or 32 signals.

28. The module as recited in claim 1, wherein the one or more beamformers are configured into one or more beamformer matrix modules (BFMMs), each BFMM comprising:

four (4) input ports, each input port connected to an amplifier and configured to receive a signal originating from an antenna element;

four (4) 1:16 power dividers, each power divider connected to one of the input ports and configured to produce 16 separate signals from the one received signal for a total of 64 separate signals;

sixty-four (64) phase shifters, each phase shifter configured to receive one of the 64 separate signals; and sixteen (16) 4:1 power combiners, each of the 16 power combiners connected to 4 phase shifters and configured to generate an output signal from the 4 separate signals input from the phase shifters;

wherein each BFMM is configured to receive 4 input signals from 4 antenna elements and generate an output comprising 16 signals, wherein at least some of the 16 signals are phase shifted with respect to other of the 16 signals.

29. The module as recited in claim 28, wherein the module can be configured to generate an output comprising 16 signals, or the module can be configured to generate an output comprising 32 signals.

30. The module as recited in claim 29, wherein for a given number of antenna elements and a given antenna element type, a module generating an output comprising 32 signals comprises twice as many BFMM as a module generating an output comprising 16 signals.

31. The module as recited in claim 29, wherein the module further comprises X-number of M:1-type beam combiners, wherein X is the number of signals in the output of the module and M is number of circuit board assemblies in the module.

32. The module as recited in claim 28, wherein each BFMM further comprise sixty-four (64) attenuators, each of the attenuators being associate with one of the 64 phase shifters.

33. An antenna array comprising:

a plurality of configurable antenna array modules interlocking so as to form a contiguous antenna array structure, wherein each antenna array module comprises:

a plurality of antenna elements, each antenna element operable to receive and output an electromagnetic wave signal, the antenna elements arranged adjacent to each other;

a plurality of antenna element interfaces, each antenna element interface coupled to one of be plurality of antenna elements; and one or more circuit board assemblies, the one or more circuit board assemblies arranged substantially parallel to each other, each circuit board assembly having a plurality of antenna elements connected hereto, each antenna element connected to the circuit board assembly by all antenna element interface, each circuit board assembly comprising:

a plurality of amplifiers, each amplifier operable to amplify a received signal from an antenna element, each amplifier receiving a signal from an antenna element via an antenna element interface; and one or more beamformers, each beamformer coupled to an output of an amplifier;

wherein the one or more circuit board assemblies, the plurality of antenna element interfaces and the plurality of antenna elements are arranged so as to form a module and wherein the module can be configured with different scan coverages by altering one or more of the number of antenna elements, the number of circuit boards, a dimension of the antenna elements, or the number of beamformers on each circuit board assembly; and signal frequency, control, and DC power harnesses to electrically connect the plurality of antenna array modules so as to form the antenna array.

34. The antenna array of claim 30, wherein the antenna elements of each module are arranged adjacent to each other so as to form a grid pattern.

35. The antenna array of claim 34, wherein the antenna elements of each module are arranged adjacent to each other so as to form a triangular grid pattern.

36. The antenna array of claim 34, wherein the antenna elements of each module are arranged adjacent to each other so as to form a rectangular grid pattern.

37. The antenna array as recited in claim 33, wherein the antenna elements comprises an antenna element selected from the group consisting of a 1×1 antenna elements, a 2×1 antenna element, a 1×2 antenna element, a 2×2 antenna element, a 4×1 antenna element, a 1×4 antenna element, a 4×2 antenna element, a 2×4 antenna element, and a 4×4 antenna element.

38. The antenna array of claim 33, wherein the antenna elements of each module are arranged so as to form a plurality of rows and the antenna elements and antenna element interfaces are oriented oppositely in adjacent rows.

39. The antenna array of claim 38, wherein the circuit boards of each module have non-uniform spacing within the module.

40. The antenna array of claim 39, wherein the antenna element interfaces comprise waveguide assemblies.

41. The antenna array of claim 33, wherein the antenna elements of each module are arranged so as to form a plurality of rows and the antenna elements and antenna element interfaces are oriented similarly in adjacent rows.

42. The antenna array of claim 41, wherein the circuit boards of each module have uniform spacing within the module.

43. The antenna array of claim 42, wherein the antenna element interfaces comprise waveguide assemblies.

44. The antenna array of claim 33, wherein each antenna element interface further comprises a waveguide assembly.

45. The antenna array of claim 44, wherein each waveguide assembly further comprises a waveguide liter.

46. The antenna array of claim 44, wherein each waveguide assembly further comprises a signal probe operable to convert an electromagnetic wave signal from the antenna to a corresponding electrical signal and output the electrical signal to the amplifier.

47. The antenna array of claim 33, wherein each antenna array module comprises larger antenna elements and a correspondingly smaller number of circuit board assemblies.

48. The antenna array of claim 33, wherein each antenna array module comprises larger antenna elements and correspondingly less populated circuit board assemblies.

49. The antenna array of claim 33, wherein each antenna array module comprises larger antenna elements and a correspondingly smaller number of less populated circuit board assemblies.

50. The antenna array of claim 33, wherein each antenna array module comprises smaller antenna elements and a correspondingly larger number of circuit board assemblies.

51. The antenna array of claim 33, wherein each antenna array module comprises smaller antenna elements and correspondingly more populated circuit board assemblies.

52. The antenna array of claim 33, wherein each antenna array module comprises smaller antenna elements and a correspondingly larger number of more populated circuit board assemblies.

53. The antenna array of claim 33, wherein the beamformers are radio frequency beamformers and the signal harness is a radio frequency power combiner.

54. The antenna array of claim 33, wherein the beamformers are intermediate frequency beamformers and the signal harness is an intermediate frequency power combiner.

55. The antenna array of claim 33, wherein connections between the plurality of amplifiers and the plurality of beamformers are interleaved so that if a number of amplifiers are omitted from a circuit board assembly, at least one beamformer can be omitted from the circuit board assembly.

56. The antenna array as recited in claim 33, wherein the one or more beamformers comprise a power divider and a plurality of phase shifters, the power divider configured to receive a signal from an amplifier and divide the signal into a plurality of signals that are coupled to the plurality of phase shifters.

57. The antenna array as recited in claim 56, wherein the one or more beamformers comprises 16 or 32 phase shifters, and the power divider is configured to divide the received signal into 16 or 32 signals.

58. The antenna array as recited in claim 56, wherein the one or more beamformers further comprise a plurality of attenuators.

59. The antenna array as recited in claim 58, wherein the one or more beamformers comprise 16 or 32 phase shifters and attenuators, and the power divider is configured to divide the received signal into 16 or 32 signals.

60. The antenna array as recited in claim 33, wherein the one or more beamformers are configured into one or more beamformer matrix modules (BFMMs), each BFMM comprising:

four (4) input ports each input port connected to an amplifier and configured to receive a signal originating from an antenna element;

four (4) 1:16 power dividers, each power divider connected to one of the input ports and configured to produce 16 separate signals from the one received signal for a total of 64 separate signals:

sixty-four (64) phase shifters, each phase shifter configured to receive one of the 64 separate signals; and sixteen (16) 4:1 power combiners, each of the 16 power combiners connected to 4 phase shifters and configured to generate an output signal from the 4 separate signals input from the phase shifters;

wherein each BFMM is configured to receive 4 input signals from 4 antenna elements and generate an output comprising 16 signals, wherein at least some of the 16 signals are phase shifted with respect to other of the 16 signals.

61. The antenna array as recited in claim 60, wherein each module can be configured to generate an output comprising 16 signals, or each module call be configured to generate an output comprising 32 signals.

62. The antenna array as recited in claim 61, wherein for a given number of antenna elements and a given antenna element type, a module generating an output comprising 32 signals comprises twice as many BFMMs as a module generating an output comprising 16 signals.

63. The antenna array as recited in claim 61, wherein each module further comprises X-number of M:1-type beam combiners, wherein X is the number of signals in the output of the module, and M is the number of circuit board assemblies in the module.

64. The antenna array as recited in claim 63, wherein the antenna array further comprises Y-number of N:1-type beam combiners, wherein Y is the number of signals in the output of each module, and N is the number of modules in the antenna array.

65. The antenna array as recited in claim 60, wherein each BFMM further comprise sixty-four (64) attenuators, each of the attenuators being associate with one of the 64 phase shifters.

66. A configurable modular array building block for all antenna array comprising:

a plurality of antenna elements, each antenna element operable to receive and transmit an electromagnetic wave signal, the antenna elements arranged adjacent to each other;

a plurality of antenna element interfaces, each antenna element interface coupled to one of the plurality of antenna elements; and one or more circuit board assemblies, the one or more circuit board assemblies arranged substantially parallel to each other, each circuit board assembly having a plurality of antenna elements connected thereto, each antenna element connected to the circuit board assembly by an antenna element interface, each circuit board assembly comprising:

one or more beamformers; and a plurality of amplifiers coupled to one or more of the beamformers, each amplifier operable to amplify a signal being transmitted from one or more of the beamformers to an antenna element, each amplifier transmitting a signal to an antenna element via an antenna element interface;

wherein the one or more circuit board assemblies, the plurality of antenna element interfaces and the plurality of antenna elements are arranged so as to form a module, and wherein the module can be configured with different scan coverages by altering one or more of the number of antenna elements, the number of circuit boards, a dimension of the antenna elements, or the number of beamformers on each circuit board assembly.

67. The module of claim 66, wherein the antenna elements are arranged adjacent to each other so as to form a grid pattern.

68. The module of claim 67, wherein the antenna elements are arranged adjacent to each other so as to form a triangular grid pattern.

69. The module of claim 67, wherein the antenna elements are arranged adjacent to each other so as to form a rectangular grid pattern.

70. The module as recited in claim 66, wherein the antenna elements comprises an antenna element selected from the group consisting of a 1×1 antenna elements, a 2×1 antenna element, a 1×2 antenna element, a 2×2 antenna element, a 4×1 antenna element, a 1×4 antenna element, a 4×2 antenna element, a 2×4 antenna element, and a 4×4 antenna element.

71. The module of claim 66, wherein the antenna elements are arranged adjacent so as to form a plurality of rows and the antenna elements and antenna element interfaces are oriented oppositely in adjacent rows.

72. The module of claim 71, wherein the circuit boards have non-uniform spacing within module.

73. The module of claim 72, wherein the antenna element interfaces comprise waveguide assemblies.

74. The module of claim 66, wherein the antenna elements are arranged so as to form a plurality of rows and the antenna elements and antenna element interfaces are oriented similarly in adjacent rows.

75. The module of claim 74, wherein the circuit boards have uniform spacing within module.

76. The module of claim 75, wherein the antenna element interfaces comprise wavelength assemblies.

77. The module of claim 66, wherein each antenna element interface further comprises a waveguide assembly.

78. The module of claim 77, wherein each waveguide assembly further comprises a waveguide filter.

79. The module of claim 77, wherein each waveguide assembly further comprises a signal probe operable to convert an electrical signal at the output of the amplifier to a corresponding electromagnetic wave signal in the waveguide.

80. The module of claim 66, comprising larger antenna elements and a correspondingly smaller number of circuit board assemblies.

81. The module of claim 66, comprising larger antenna elements and correspondingly less populated circuit board assemblies.

82. The module of claim 66, comprising larger antenna elements and a correspondingly smaller number of less populated circuit board assemblies.

83. The module of claim 66, comprising smaller antenna elements and a correspondingly larger number of circuit board assemblies.

84. The module of claim 66, comprising smaller antenna elements and correspondingly more populated circuit board assemblies.

85. The module of claim 66, comprising smaller antenna elements and a correspondingly larger number of more populated circuit board assemblies.

86. The module of claim 66, wherein the beamformers are radio frequency beamformers.

87. The module of claim 66, wherein the beamformers are intermediate frequency beamformers.

88. The module of claim 66, wherein connections between the plurality of amplifier and the plurality of beamformers are interleaved so that if a number of amplifiers are omitted from a circuit board assembly, at least one beamformer can be omitted from the circuit board assembly.

89. The module as recited in claim 66, wherein the one or more beamformers comprise a plurality of phase shifters and a power combiner, the plurality of phase shifters are configured to receive signals from beam ports and are coupled to the power combiner, the power combiner further being coupled to an amplifier and configured to receive signals from the plurality of phase shifters and combine the signals from the phase shifters into a single signal.

90. The module as recited in claim 89, wherein the one or more beamformers comprises 16 or 32 phase shifters, and the power combiner is configured to combine the 16 or 32 signals from the 16 or 32 phase shifters, respectively.

91. The module as recited in claim 89, wherein the one or more beamformers further comprise a plurality of attenuators.

92. The module as recited in claim 91, wherein the one or more beamformers comprise 16 or 32 phase shifters and attenuators, and the power divider is configured to divide the received signal into 16 or 32 signals.

93. The module as recited in claim 66, wherein the one or more beamformers are configured into one or more beamformer matrix modules (BFMMs), each BFMM comprising:

sixteen (16) input ports, each input port configured to receive a signal from one of 16 beam ports;

sixteen (16) 1:4 power dividers, each power divider configured to divide each of the 16 signals from the 16 beam ports into 4 separate signals for a total of 64 signals;

sixty-four (64) phase shifters, each phase shifter configured to receive one of the 64 separate signals; and four (4) 16:1 power combiners, each of the 4 power combiners connected to 16 phase shifters and configured to generate an output signal from the 16 separate signals input from the phase shifters;

wherein each BFMM is configured to receive 16 input signals from 16 beam ports and generate 4 output signals each being coupled to an antenna element.

94. The module as recited in claim 93, wherein the module can be configured to receive signals from 16 beam ports, or the module can be configured to receive signals from 32 beam ports.

95. The module as recited in claim 94, wherein for a given number of antenna elements and a given antenna element type, a module receiving signals from 32 beam ports comprises twice as many BFMMs as a module receiving signals from 16 beam ports.

96. The module as recited in claim 93, wherein the module further comprises X-number of 1:M-type beam dividers, wherein X is the number of beam port signals the module receives, and M is the number of circuit board assemblies in the module.

97. The module as recited in claim 93, wherein each BFMM further comprise sixty-four (64) attenuators, each of the attenuators being associate with one of the 64 phase shifters.

98. An antenna array comprising:

a plurality of configurable antenna array modifies interlocking so as to form a contiguous antenna array structure, wherein each antenna array module comprises:

a plurality of antenna elements, each antenna element operable to receive and transmit an electromagnetic wave signal, the antenna elements arranged adjacent to each other;

a plurality of antenna element interfaces each antenna element interface coupled to one of the plurality of antenna elements; and one or more circuit board assemblies, the one or more circuit board assemblies arranged substantially parallel to each other, each circuit board assembly having a plurality of antenna elements connected thereto, each antenna element connected to the circuit board assembly by an antenna element interface, each circuit board assembly comprising:

one or more beamformers; and a plurality of amplifiers coupled to one or more of the beamformers, each amplifier operable to amplify a signal being transmitted from one or more of the beamformers to an antenna element, each amplifier transmitting a signal to an antenna element via an antenna element interface;

wherein the one or more circuit board assemblies, the plurality of antenna element interfaces and the plurality of antenna elements are arranged so as to form a module, and wherein the module can be configured with different scan coverages by altering one or more of the number of antenna elements, the number of circuit boards, a dimension of the antenna elements, or the number of beamformers on each circuit board assembly; and signal frequency, control, and DC power harnesses to electrically connect the plurality of antenna array modules so as to form the antenna array.

99. The antenna array of claim 98, wherein the antenna elements of each module are arranged adjacent to each other so as to form pattern.

100. The antenna array of claim 99, wherein the antenna elements of each module are arranged adjacent to each other so as to form a triangular grid pattern.

101. The antenna array of claim 99, wherein the antenna elements of each module are arranged adjacent to each other so as to form a rectangular grid pattern.

102. The antenna array as recited in claim 98, wherein the antenna elements comprises an antenna element selected from the group consisting of a 1×1 antenna elements, a 2×1 antenna element, a 1×2 antenna element, a 2×2 antenna element, a 4×1 antenna element, a 1×4 antenna element, a 4×2 antenna element, a 2×4 antenna element, and a 4×4 antenna element.

103. The antenna array of claim 98, wherein the antenna elements of each module are arranged so as to form a plurality of rows and the antenna elements and antenna element interfaces are oriented oppositely in adjacent rows.

104. The antenna array of claim 103, wherein the circuit boards of each module have non-uniform spacing within the module.

105. The antenna array of claim 104, wherein the antenna element interfaces comprise waveguide assemblies.

106. The antenna array of claim 98, wherein the antenna elements of each module are arranged so as to form a plurality of rows and the antenna elements and antenna element interfaces are oriented similarly in adjacent rows.

107. The antenna array of claim 106, wherein the circuit boards of each module have uniform spacing within the module.

108. The antenna array of claim 107, wherein the antenna element interfaces comprise waveguide assemblies.

109. The antenna array of claim 98, wherein each antenna element interface further comprises a waveguide assembly.

110. The antenna array of claim 109, wherein each waveguide assembly further comprises a waveguide filter.

111. The antenna array of claim 109, wherein each waveguide assembly further comprises a signal probe operable to convert an electrical signal at the output of the amplifier to a corresponding electromagnetic wave signal in the waveguide.

112. The antenna array of claim 98, wherein each antenna array module comprises larger antenna elements and a correspondingly smaller number of circuit board assemblies.

113. The antenna array of claim 98, wherein each antenna array module comprises larger antenna elements and correspondingly less populated circuit board assemblies.

114. The antenna array of claim 98, wherein each antenna array module comprises larger antenna elements and a correspondingly smaller number of less populated circuit board assemblies.

115. The antenna array of claim 98, wherein each antenna array module comprises smaller antenna elements and a correspondingly larger number of circuit board assemblies.

116. The antenna array of claim 98, wherein each antenna array module comprises smaller antenna elements and correspondingly more populated circuit board assemblies.

117. The antenna array of claim 98, wherein each antenna array module comprises smaller antenna elements and a correspondingly larger number of more populated circuit board assemblies.

118. The antenna array of claim 98, wherein the beamformers are radio frequency beamformers and the signal harness is a radio frequency power divider.

119. The antenna array of claim 98, wherein the beamformers are intermediate frequency beamformers and the signal harness is an intermediate frequency power divider.

120. The module of claim 98, wherein connections between the plurality of amplifiers and the plurality of beamformers are interleaved so that if a number of amplifiers are omitted from a circuit board assembly, at least one beamformer can be omitted from the circuit board assembly.

121. The antenna array as recited in claim 98, wherein the one or more beamformers comprise a plurality of phase shifters and a power combiner, the plurality of phase shifters are configured to receive signals from beam ports and are coupled to the power combiner, the power combiner further being coupled to an amplifier and configured to receive signals from the plurality of phase shifters and combine the signals from the phase shifters into a single signal.

122. The antenna array as recited in claim 121, wherein the one or more beamformers comprises 16 or 32 phase shifters, and the power combiner is configured to combine the 16 or 32 signals from the 16 or 32 phase shifters, respectively.

123. The antenna array as recited in claim 121, wherein the one or more beamformers further comprise a plurality of attenuators.

124. The antenna array as recited in claim 123, wherein the one or more beamformers comprise 16 or 32 phase shifters and attenuators, and the power divider is configured to divide the received signal into 16 or 32 signals.

125. The antenna array as recited in claim 98, wherein the one or more beamformers are configured into one or more beamformer matrix modules (BFMMs), each BFMM comprising:

sixteen (16) input ports, each input port configured to receive a signal from one of 16 beam ports;

sixteen (16) 1:4 power dividers, each power divider configured to divide each of the 16 signals from the 16 beam ports into 4 separate signals for a total of 64 signals;

sixty-four (64) phase shifters, each phase shifter configured to receive one of the 64 separate signals; and four (4) 16:1 power combiners, each of the 4 power combiners connected to 16 phase shifters and configured to generate an output signal from the 16 separate signals input from the phase shifters;

wherein each BFMM is configured to receive 16 input signals from 16 beam ports and generate 4 output signals each being coupled to an antenna element.

126. The antenna array as recited in claim 125, wherein each module can be configured to receive signals from 16 beam ports, or each module can be configured to receive signals from 32 beam ports.

127. The antenna array as recited in claim 126, wherein for a given number of antenna elements and a given antenna, element type, a module receiving signals from 32 beam ports comprises twice as many BFMMs as a module receiving signals from 16 beam ports.

128. The antenna array as recited in claim 126, wherein the antenna array further comprises Y-number of 1:N-type beam, dividers, wherein Y is the number of beam port signals the antenna array receives, and N is the number of modules in the antenna array.

129. The antenna array as recited in claim 128, wherein each module further comprises X-number of 1:M-type beam dividers, wherein X is the number of beam port signals the antenna array receives, and M is the number of circuit board assemblies in the module.

130. The antenna array as recited in claim 125, wherein each BFMM further comprise sixty-four (64) attenuators, each of the attenuators being associate with one of the 64 phase shifters.

131. An antenna array comprising:

a plurality of configurable antenna array modules interlocking so as to form a contiguous antenna array structure, wherein each antenna array module comprises:

a plurality of antenna elements, each antenna element operable to receive and output an electromagnetic wave signal and to transmit an electromagnetic wave signal, the antenna elements arranged adjacent to each other;

a plurality of antenna element interfaces, each antenna element interface coupled to one of the plurality of antenna elements; and one or more of the circuit board assemblies, the circuit board assemblies arranged substantially parallel to each other, each circuit board assembly having a plurality of antenna elements connected thereto, each antenna element connected to the circuit board assembly by an antenna element interface, each circuit board assembly comprising:

one or more beamformers;

a plurality of receive amplifiers, each receive amplifier operable to amplify a signal being received by an antenna element and transmitted to one or more of the beamformers, a plurality of transmit amplifiers, each transmit amplifier operable to amplify a signal being transmitted from one or more of the beamformers to an antenna element, a plurality of first duplexing devices, each of the first duplexing devices coupling a transmit amplifier output and a receive amplifier input to an antenna element interface, a plurality of second duplexing devices, each of the second duplexing devices coupling one or more beamformers to a transmit amplifier input and to a receive amplifier output;

wherein the one or more circuit board assemblies, the plurality of antenna element interfaces and the plurality of antenna elements are arranged so as to form a module, and wherein the module can be configured with different scan coverages by altering one or more of the number of antenna elements, the number of circuit boards, a dimension of the antenna elements, or the number of beamformers on each circuit board assembly; and signal frequency, control, and DC power harnesses to electrically connect the plurality of antenna array modules so as to form antenna array.

132. The antenna array of claim 131, wherein the antenna elements of each module are arranged adjacent to each other so as to form a grid pattern.

133. The antenna array of claim 132, wherein the antenna elements of each module are arranged adjacent to each other so as to form a triangular grid pattern.

134. The antenna array of claim 132, wherein the antenna elements of each module are arranged adjacent to each other so as to form a rectangular grid pattern.

135. The antenna array of claim 131, wherein the antenna elements of each module are arranged so as to form a plurality of rows and the antenna elements and antenna element interfaces are oriented oppositely in adjacent rows.

136. The antenna array of claim 135, wherein the circuit boards of each module have non-uniform spacing within the module.

137. The antenna array of claim 136, wherein the antenna element interfaces comprise waveguide assemblies.

138. The antenna array of claim 131, wherein the antenna elements of each module are arranged so as to form a plurality of rows and the antenna elements and antenna element interfaces are oriented similarly in adjacent rows.

139. The antenna array of claim 138, wherein the circuit boards of each module have uniform spacing within the module.

140. The antenna array of claim 139, wherein the antenna element interfaces comprise waveguide assemblies.

141. The antenna array of claim 131, wherein each antenna element interface further comprises a waveguide assembly.

142. The antenna array of claim 141, wherein each waveguide assembly further comprises a waveguide filter.

143. The antenna array of claim 141, wherein each waveguide assembly further comprises a signal probe operable to convert an electromagnetic wave signal from the antenna to a corresponding electrical signal and output the electrical signal to the amplifier, or an electrical signal at the output of the amplifier to a corresponding electromagnetic wave signal in the waveguide.

144. The antenna array of claim 131, wherein each antenna array module comprises larger antenna elements and a correspondingly smaller number of circuit board assemblies.

145. The antenna array of claim 131, wherein each antenna array module comprises larger antenna elements and correspondingly less populated circuit board assemblies.

146. The antenna array of claim 131, wherein each antenna array module comprises larger antenna elements and a correspondingly smaller number of less populated circuit board assemblies.

147. The antenna array of claim 131, wherein each antenna array module comprises smaller antenna elements and a correspondingly larger number of circuit board assemblies.

148. The antenna array of claim 131, wherein each antenna array module comprises smaller antenna elements and correspondingly more populated circuit board assemblies.

149. The antenna array of claim 131, wherein each antenna array module comprises smaller antenna elements and a correspondingly larger number of more populated circuit board assemblies.

150. The antenna array of claim 131, wherein the beamformers are radio frequency beamformers and the signal harness is a radio frequency power divider/combiner.

151. The antenna array of claim 131, wherein the beamformers are intermediate frequency beamformers and the signal harness is an intermediate frequency power divider/combiner.

152. The module of claim 131, wherein connections between the plurality of amplifliers and the plurality of beamformers are interleaved so that if a number of amplifiers are omitted from a circuit board assembly, at least one beamformer can be omitted from the circuit board assembly.

* * * * *

UNITED STATES PATENT AND TRADEMARK OFFICE

CERTIFICATE OF CORRECTION

PATENT NO. : 6,703,976 B2
DATED : March 9, 2004
INVENTOR(S) : Anthony W. Jacomb-Hood et al.

It is certified that error appears in the above-identified patent and that said Letters Patent is hereby corrected as shown below:

Column 18,
Line 40, “hereto” should read -- thereto --.
Line 62, “claim 30,” should read -- claim 33, --.

Column 19,
Line 31, “waveguide liter.” should read -- waveguide filter. --.

Column 20,
Line 27, “signals:” should read -- signals; --.
Line 62, “block for all” should read -- block for an --.

Column 21,
Line 44, “adjacent” should be deleted.
Lines 48 and 56, ‘within module.” should read -- within the module. --.

Column 22,
Line 24, “amplifier” should be -- amplifiers --.

Column 23,
Line 18, “modifies” should read -- modules --.
Line 26, “interfaces” should read -- interfaces, --.
Line 58, “to form pattern.” should read -- to form a grid pattern. --.

UNITED STATES PATENT AND TRADEMARK OFFICE

CERTIFICATE OF CORRECTION

PATENT NO. : 6,703,976 B2
DATED : March 9, 2004
INVENTOR(S) : Anthony W. Jacomb-Hood et al.

It is certified that error appears in the above-identified patent and that said Letters Patent is hereby corrected as shown below:

Column 25,
Lines 41-42, "a given antenna, element" should read -- a given antenna element --.
Line 47, "beam, dividers," should read -- beam dividers, --.

Signed and Sealed this

Third Day of August, 2004

JON W. DUDAS
*Acting Director of the United States Patent and Trademark Office*